US010669695B2

(12) United States Patent
Ito et al.

(10) Patent No.: US 10,669,695 B2
(45) Date of Patent: Jun. 2, 2020

(54) HYDRAULIC DRIVING DEVICE FOR WORKING MACHINE

(71) Applicant: Hitachi Construction Machinery Co., Ltd., Taito-ku, Tokyo (JP)

(72) Inventors: Masamichi Ito, Ibaraki (JP); Takatoshi Ooki, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/327,150

(22) PCT Filed: Jan. 31, 2018

(86) PCT No.: PCT/JP2018/003313
§ 371 (c)(1),
(2) Date: Feb. 21, 2019

(87) PCT Pub. No.: WO2018/168236
PCT Pub. Date: Sep. 20, 2018

(65) Prior Publication Data

US 2019/0177952 A1 Jun. 13, 2019

(30) Foreign Application Priority Data

Mar. 14, 2017 (JP) ..... 2017-048133

(51) Int. Cl.
*F15B 21/14* (2006.01)
*E02F 9/22* (2006.01)
*F15B 11/05* (2006.01)

(52) U.S. Cl.
CPC ..... *E02F 9/2239* (2013.01); *E02F 9/22* (2013.01); *E02F 9/2225* (2013.01); *F15B 11/05* (2013.01);

(Continued)

(58) Field of Classification Search
CPC ..... F15B 21/14; F15B 2211/353; F15B 2211/5156
See application file for complete search history.

(56) References Cited

U.S. PATENT DOCUMENTS 5,787,963 A * 8/1998 Tsuji ..... B22D 27/11 164/120
9,945,396 B2 * 4/2018 Shang ..... F15B 11/024
2017/0198731 A1 * 7/2017 Sugano ..... F15B 21/14

FOREIGN PATENT DOCUMENTS

JP 2007-170485 A 7/2007
JP 2016-35321 A 3/2016
JP 2017-20544 A 1/2017

OTHER PUBLICATIONS

International Search Report (PCT/ISA/210) issued in PCT Application No. PCT/JP2018/003313 dated Apr. 24, 2018 with English translation (three (3) pages).

(Continued)

*Primary Examiner* — Thomas E Lazo
(74) *Attorney, Agent, or Firm* — Crowell & Moring LLP

(57) ABSTRACT

There is provided a hydraulic driving device for working machine having operability handling a change in burden weight in a front working device due to a loaded burden and the like when the working machine that accumulates energy in an accumulator and recovers and regenerates the energy performs an operation of lowering the front working device. A hydraulic driving device 5 includes a main pump 101, a boom cylinder 3, a tank 20, a flow rate control valve 6, an accumulator 300, a first differential pressure control valve 201, and a second differential pressure control valve 202. The first differential pressure control valve 201 is located between the boom cylinder 3 and the accumulator 300. The first differential pressure control valve 201 performs control on discharge oil from the boom cylinder 3 such that a (Continued)

differential pressure between before and after the flow rate control valve 6 becomes a target differential pressure. The second differential pressure control valve 202 is located between the accumulator 300 and the tank 20. The second differential pressure control valve 202 performs control on the discharge oil such that a differential pressure between an upstream pressure and a downstream pressure of the flow rate control valve 6 and the first differential pressure control valve 201 becomes the target differential pressure. The first and the second differential pressure control valves 201 and 202 are configured such that the target differential pressure increases according to an increase in pressure of the discharge oil.

5 Claims, 14 Drawing Sheets

(52) U.S. Cl.
CPC ..... *F15B 21/14* (2013.01); *F15B 2211/20546* (2013.01); *F15B 2211/20576* (2013.01)

(56) References Cited

OTHER PUBLICATIONS

Japanese-language Written Opinion (PCT/ISA/237) issued in PCT Application No. PCT/JP2018/003313 dated Apr. 24, 2018 (three (3) pages).

* cited by examiner

HYDRAULIC DRIVING DEVICE FOR WORKING MACHINE

TECHNICAL FIELD

The present invention relates to a hydraulic driving device for a working machine.

BACKGROUND ART

There has been known the following energy recovery/regeneration (recycle) device. To recover potential energy of a front working device for a working machine typified by, for example, a hydraulic excavator, the energy recovery/regeneration (recycle) device communicates between a bottom chamber and a rod chamber of a boom cylinder (hydraulic actuator) and regenerates pressure oil flown out from the bottom chamber of the boom cylinder to the rod chamber to boost bottom pressure of the boom cylinder while accumulating energy in an accumulator.

For example, the energy recovery/regeneration device described in Patent Literature 1 includes a pressure compensation valve for recovery and a recovery flow rate control valve on a route leading to an accumulator from a bottom chamber of a boom cylinder. The pressure compensation valve for recovery performs control so as to constantly maintain a differential pressure between before and after a meter-out throttle of the recovery flow rate control valve. This allows controlling a flow rate through the recovery flow rate control valve at a target flow rate according to an opening area of the recovery flow rate control valve without being affected by accumulator pressure, which is changed by the accumulation situation of the accumulator, thus controlling a contraction speed of the boom cylinder at a predetermined target speed.

CITATION LIST

Patent Literature

PATENT LITERATURE 1: Japanese Unexamined Patent Application
Publication No. 2007-170485

SUMMARY OF INVENTION

Technical Problem

Generally, when a hydraulic excavator that does not include the energy recovery/regeneration device, which accumulates the energy in the accumulator, performs a boom lowering operation in the air, the hydraulic excavator does not perform the above-described pressure control on the meter-out throttle of the flow rate control valve. Therefore, performing the boom lowering operation with a burden such as earth and sand lifted increases a load due to own weight of the burden, making the cylinder speed of the boom cylinder fast. Accordingly, when an operator carries a heavy burden, the operator operates the front working device having a general perception that the front working device falls down faster than the case where the front working device is unladen.

However, the energy recovery/regeneration device described in Patent Literature 1 controls the cylinder speed of the boom cylinder to be constant regardless of a magnitude of a load. Therefore, even when the boom lowering operation is performed with the burden such as earth and sand lifted, the cylinder speed becomes a speed identical to a speed when the boom lowering operation is performed in the unladen state. This generates a gap with the general recognition of the operator, possibly affecting the operability.

Therefore, an object of the present invention is to provide a hydraulic driving device for a working machine having operability handling a change in burden weight in a front working device due to a loaded burden and the like when the working machine that accumulates energy in an accumulator and recovers and regenerates the energy performs an operation of lowering the front working device.

Solution to Problem

In order to achieve the above-described object, there is provided a hydraulic driving device for a working machine that includes a hydraulic pump, a hydraulic actuator, a tank, a flow rate control valve, an accumulator, a first differential pressure control valve, and a second differential pressure control valve. The hydraulic actuator is driven by pressure oil supplied from the hydraulic pump. The tank accumulates return oil from the hydraulic actuator. The flow rate control valve controls a flow of the pressure oil discharged from the hydraulic actuator. The accumulator accumulates the pressure oil discharged from a bottom chamber of the hydraulic actuator and flowing to the tank via the flow rate control valve. The first differential pressure control valve is located between the hydraulic actuator and the accumulator. The first differential pressure control valve performs control on the pressure oil discharged from the hydraulic actuator such that a differential pressure between an upstream pressure and a downstream pressure of the flow rate control valve becomes a predetermined target differential pressure. The second differential pressure control valve is located between the accumulator and the tank. The second differential pressure control valve performs control on the pressure oil discharged from the hydraulic actuator such that a differential pressure between an upstream pressure and a downstream pressure of the flow rate control valve and the first differential pressure control valve becomes the predetermined target differential pressure. The respective first differential pressure control valve and second differential pressure control valve are configured such that the predetermined target differential pressure increases according to an increase in pressure of the pressure oil discharged from the hydraulic actuator.

Advantageous Effects of Invention

According to the present invention, a hydraulic driving device applied to a working machine ensures having operability handling a change in burden weight in a front working device due to a loaded burden and the like when the working machine that accumulates energy in an accumulator and recovers and regenerates the energy performs an operation of lowering the front working device. Objects, configurations, and effects other than the above-described ones are made apparent from the following description of embodiments.

DESCRIPTION OF EMBODIMENTS

Hydraulic driving devices according to first to third embodiments of the present invention are applied to a hydraulic excavator as one aspect for a working machine. First, the following describes a schematic configuration of the hydraulic excavator with reference to FIG. 1.

Figure 1:
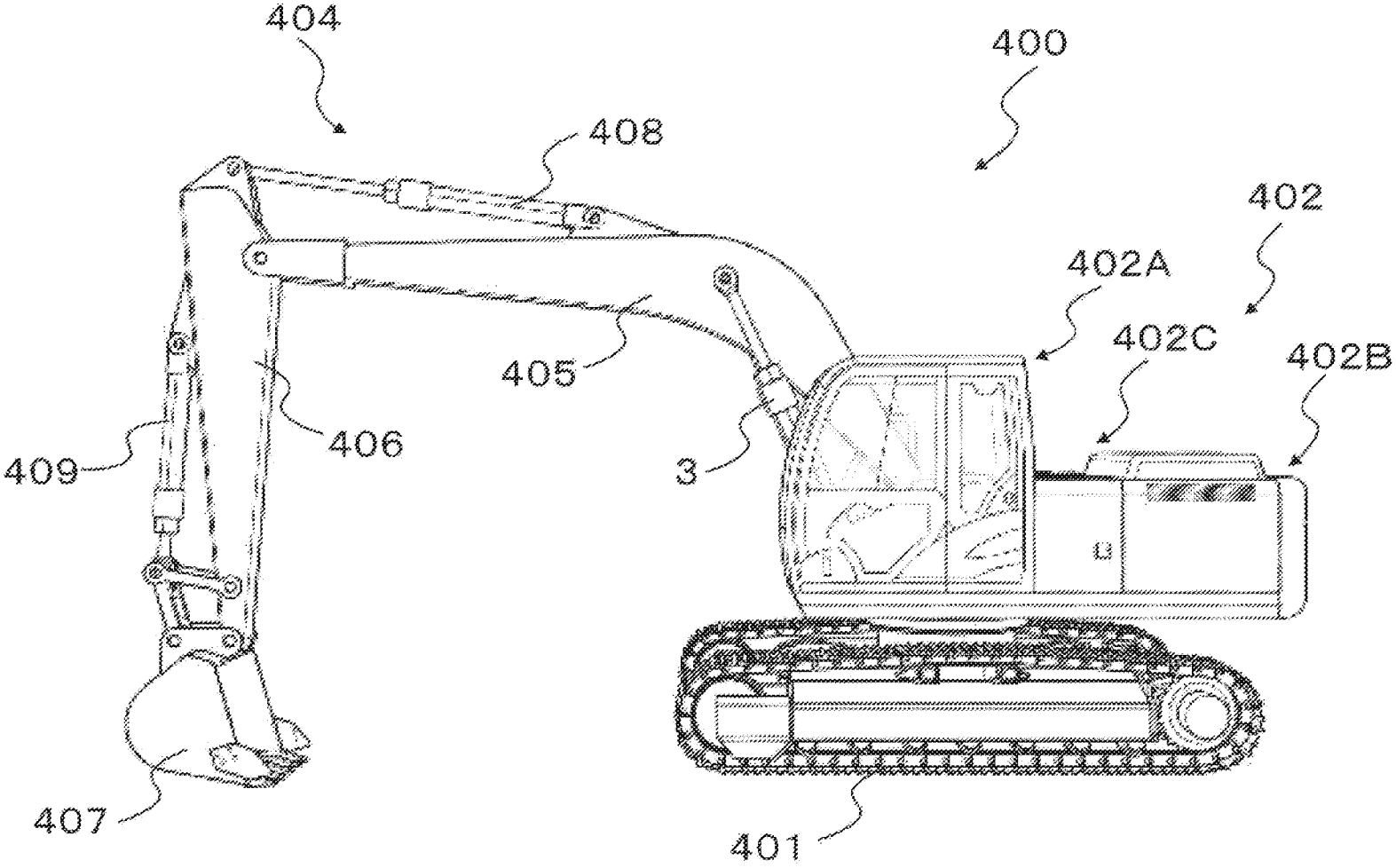
FIG. 1 is an external view illustrating one exemplary configuration of a hydraulic excavator to which the present invention is applied.

FIG. 1 is an external view illustrating one exemplary configuration of a hydraulic excavator 400.

The hydraulic excavator 400 includes an undercarriage 401 for traveling on a road surface, an upperstructure 402 rotatably mounted to the upper side of the undercarriage 401, and a front working device 404 that is coupled to the upperstructure 402, is configured to be elevated, and performs a work such as an excavation.

The upperstructure 402 includes a cab 402A, a counter weight 402B, and a machine room 402C. An operator rides on the cab 402A located at the front portion of a vehicle body. The counter weight 402B is located at the rear portion of the vehicle body to maintain a balance to avoid the vehicle body to be inclined and fallen over. The machine room 402C is located between the cab 402A and the counter weight 402B. A hydraulic driving device or similar device described later is housed inside the machine room 402C.

The front working device 404 includes a boom 405, an arm 406, and a bucket 407. The boom 405 has a base end turnably mounted to the upperstructure 402 and turns up and down with respect to the vehicle body. The arm 406 is turnably mounted to the distal end of the boom 405 and turns up and down with respect to the vehicle body. The bucket 407 is turnably mounted to the distal end of the arm 406 and turns up and down with respect to the vehicle body.

The bucket 407 can be changed to, for example, an attachment such as a grapple that grasps, for example, a wood, a rock, and a waste, and a breaker that excavates a bedrock. This allows the hydraulic excavator 400 to perform various works including excavation, crushing, and similar work using the attachment appropriate for the work.

The front working device 404 further includes a boom cylinder 3, an arm cylinder 408, and a bucket cylinder 409. The boom cylinder 3 couples the upperstructure 402 and the boom 405 together and turns the boom 405 through expansion and contraction. The arm cylinder 408 couples the boom 405 and the arm 406 together and turns the arm 406 through expansion and contraction. The bucket cylinder 409 couples the arm 406 and the bucket 407 together and turns the bucket 407 through expansion and contraction.

Figure 2:
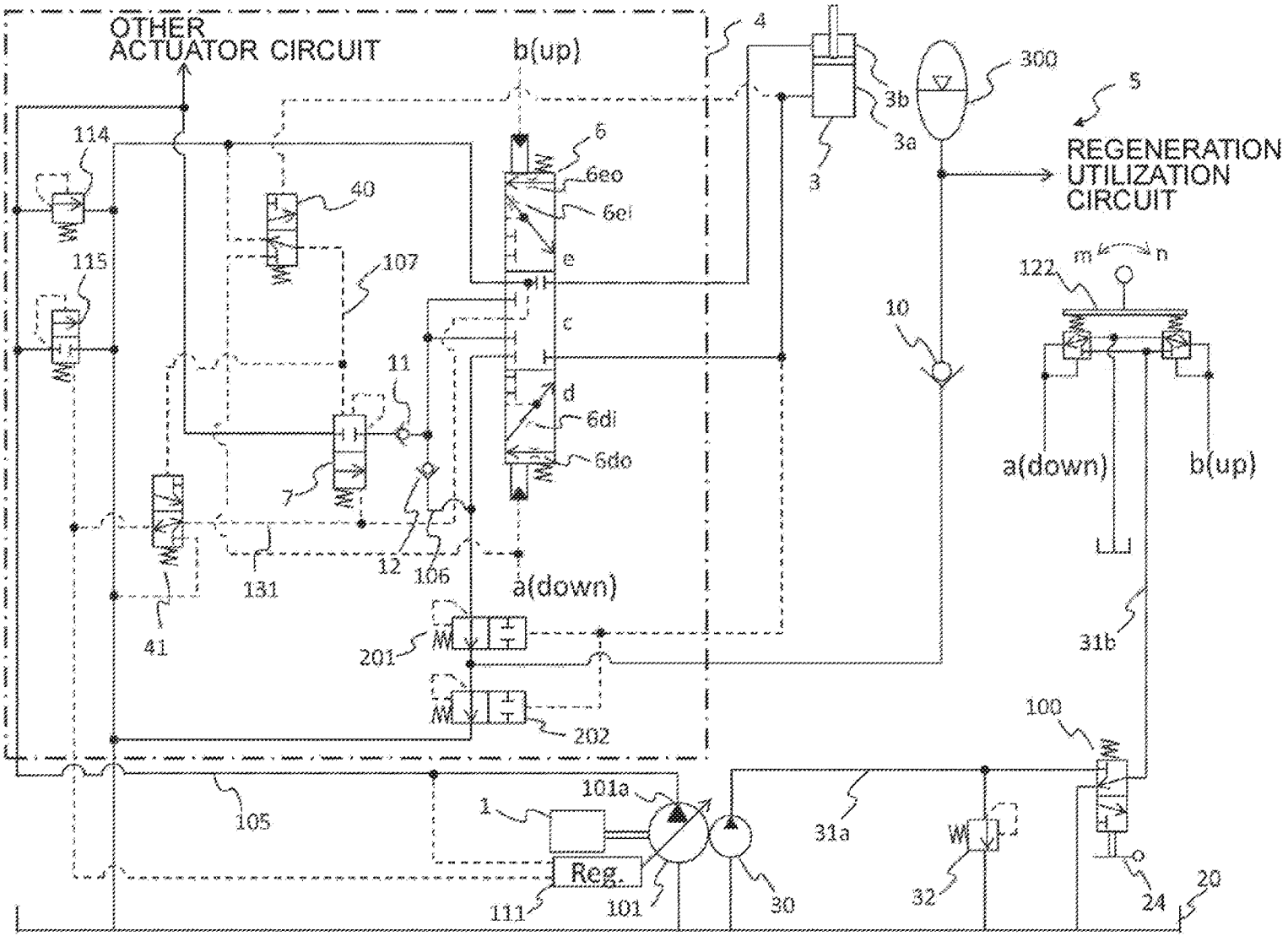
FIG. 2 is a drawing illustrating a configuration of a hydraulic driving device according to a first embodiment of the present invention.

The boom cylinder 3, arm cylinder 408, and bucket cylinder 409 are one aspect of hydraulic actuators driven by pressure oil supplied from a main pump 101 (see FIG. 2). The hydraulic driving device controls the driving of these hydraulic actuators. The following describes configurations and operations of the hydraulic driving device related to the boom cylinder 3 in each embodiment.

First Embodiment

The following describes a hydraulic driving device 5 according to the first embodiment of the present invention with reference to FIGS. 2 to 7.

(Configuration of Hydraulic Driving Device 5)

Figure 3:
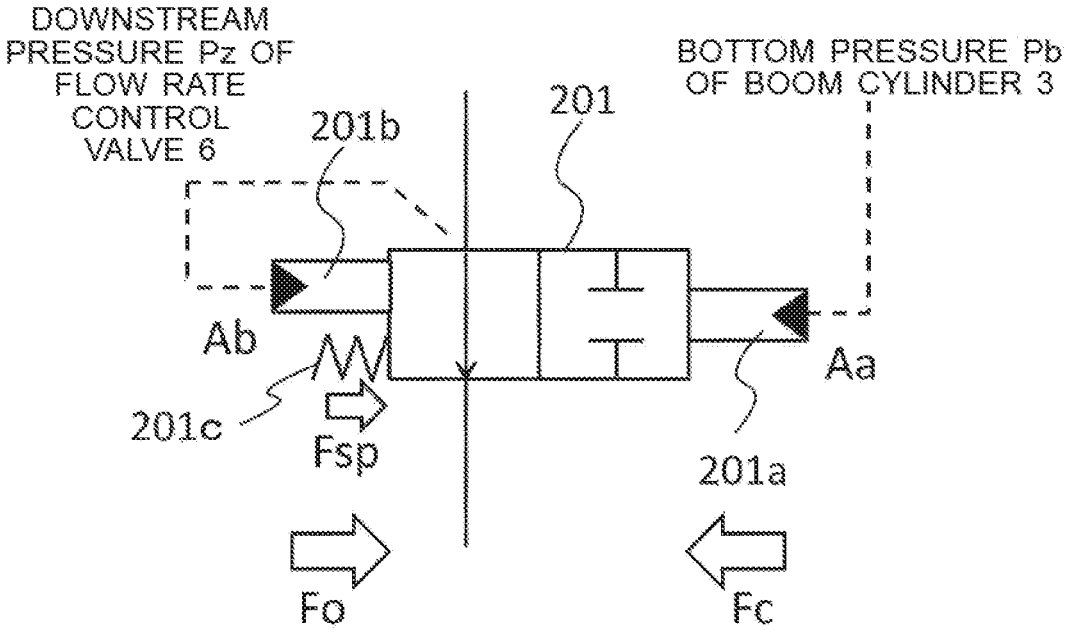
FIG. 3 is a schematic diagram describing a configuration of a first differential pressure control valve according to the first embodiment.
Figure 4:
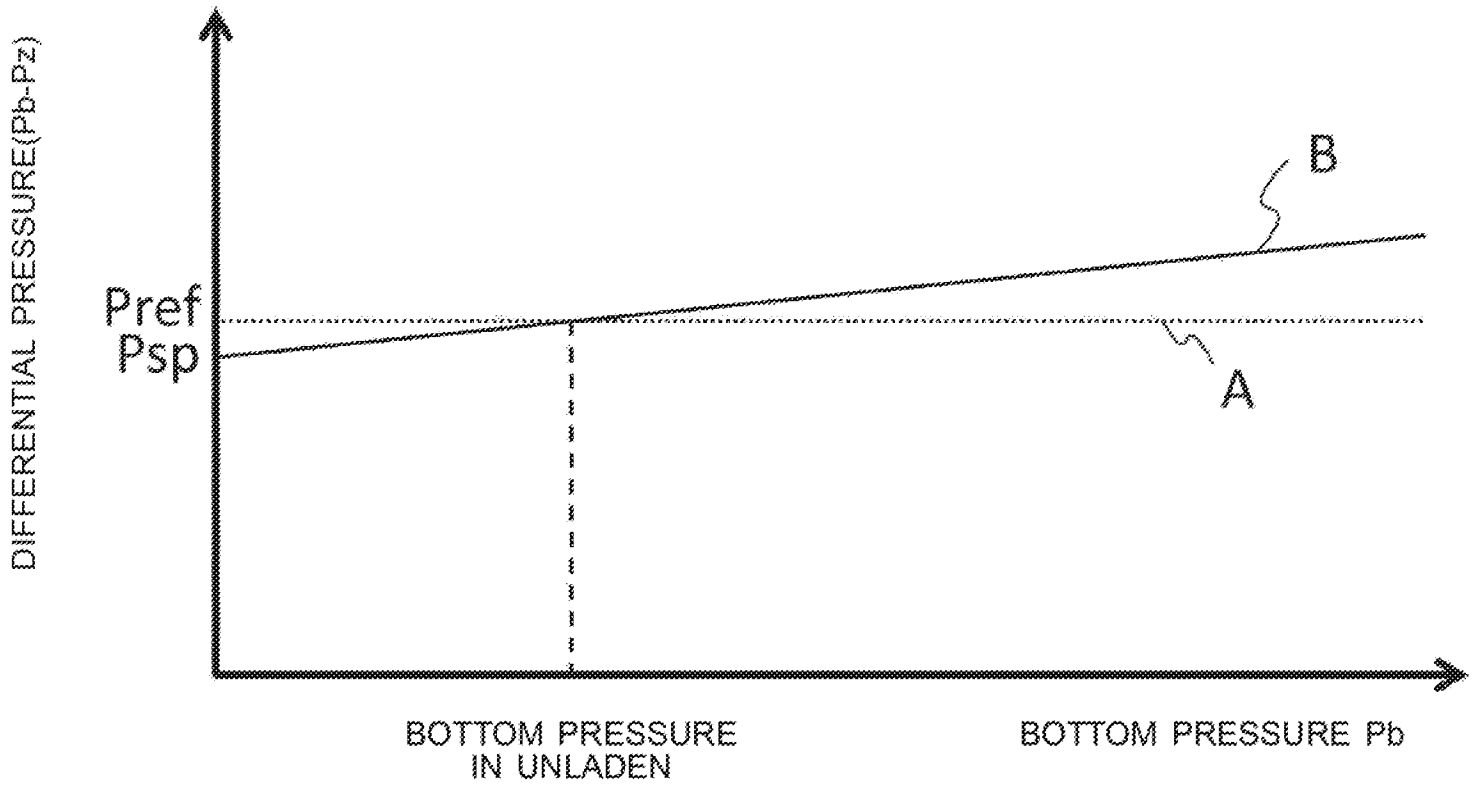
FIG. 4 is a drawing describing load-dependent characteristics of the first differential pressure control valve and a second differential pressure control valve.

First, the following describes the configuration of the hydraulic driving device 5 with reference to FIGS. 2 to 4.

FIG. 2 is a drawing illustrating the configuration of the hydraulic driving device 5 according to the first embodiment. FIG. 3 is a schematic diagram describing a configuration of a first differential pressure control valve 201 according to the first embodiment. FIG. 4 is a drawing describing load-dependent characteristics of the first differential pressure control valve 201 and a second differential pressure control valve 202.

As illustrated in FIG. 2, the hydraulic driving device 5 includes a motor 1, the main pump 101, a pilot pump 30 as a fixed displacement hydraulic pump, the boom cylinder 3, an operating device 122, a control valve unit 4, a tank 20, and an accumulator 300. The main pump 101 is driven by the motor 1 and the main pump 101 is a variable displacement type hydraulic pump having a delivery flow rate controlled by a regulator 111. The boom cylinder 3 is driven by pressure oil discharged from a discharge port 101*a* of the main pump 101 to a pressure oil supply passage 105. The operating device 122 operates the boom cylinder 3. The control valve unit 4 controls the flow rate of the pressure oil supplied from the main pump 101 to the boom cylinder 3. The tank 20 stores return oil from the boom cylinder 3. The accumulator 300 accumulates the pressure oil flowing from the control valve unit 4 to the tank 20.

The control valve unit 4 includes a flow rate control valve 6, a pressure compensation valve 7, a check valve 11, a main relief valve 114, and an unloading valve 115. The flow rate control valve 6 controls the flow of the pressure oil (the flow rate and the direction) regarding the boom cylinder 3. The pressure compensation valve 7 controls differential pressures between before and after meter-in throttles 6*di* and 6*ei* of the flow rate control valve 6. The check valve 11 prevents a backflow of the pressure oil discharged from the boom cylinder 3 to the pressure oil supply passage 105. The main relief valve 114 performs control such that the pressure of the pressure oil supply passage 105 does not become equal to or more than a set pressure. The unloading valve 115 enters an open state under a predetermined condition to return the pressure oil in the pressure oil supply passage 105 to the tank 20. The respective flow rate control valve 6, pressure compensation valve 7, check valve 11, main relief valve 114, and unloading valve 115 are coupled to the pressure oil supply passage 105.

The flow rate control valve 6 is usually at a position c illustrated in FIG. 2 by a force from a spring. When a lever of the operating device 122 is fallen over in an m direction illustrated in FIG. 2 (a lowering operation of the boom 405), a boom lowering command pressure a according to a manipulated variable of the lever is generated, and the flow rate control valve 6 strokes to a position d illustrated in FIG. 2 according to the magnitude of this boom lowering command pressure a. Thus, the meter-in throttle 6*di* and a meter-out throttle 6*do* on the position d side are open, and flows of the pressure oil discharged from a bottom chamber 3*a* of the boom cylinder 3 and the pressure oil supplied to a rod chamber 3*b* are controlled.

When the lever of the operating device 122 is fallen over in an n direction illustrated in FIG. 2 (a rising operation of the boom 405), a boom rising command pressure b according to the manipulated variable of the lever is generated, and the flow rate control valve 6 strokes to a position e illustrated in FIG. 2 according to the magnitude of this boom rising command pressure b. Thus, the meter-in throttle 6*ei* and a meter-out throttle 6*eo* on the position e side are open, and flows of the pressure oil supplied to the bottom chamber 3*a* of the boom cylinder 3 and the pressure oil discharged from the rod chamber 3*b* are controlled.

When the pressure of the pressure oil supply passage 105 becomes higher than a pressure (unloading valve set pressure) found by adding a set pressure (predetermined pressure) determined by the spring to the maximum load pressure of the plurality of actuators (for example, the boom cylinder 3, arm cylinder 408, and bucket cylinder 409) driven by the pressure oil discharged from the discharge port 101*a* of the main pump 101, the unloading valve 115 enters an open state. Thus, the pressure oil in the pressure oil supply passage 105 is returned to the tank 20.

The control valve unit 4 further includes a load detection circuit 131, a regeneration oil passage 106, and a signal oil passage 107. The load detection circuit 131 coupled to a load port of the flow rate control valve 6 detects downstream pressures of the meter-in throttles 6*di* and 6*ei* as load pressures Pl (hereinafter simply referred to as "load pressure Pl") of the boom cylinder 3. The regeneration oil passage 106 coupled to the downstream side of the check valve 11 guides the pressure oil discharged from the bottom chamber 3*a* of the boom cylinder 3 to the rod chamber 3*b* via the flow rate control valve 6. The signal oil passage 107 guides the boom lowering command pressure a, which is generated in the operating device 122, to the pressure compensation valve 7.

The regeneration oil passage 106 includes a check valve 12 that permits the pressure oil discharged from the bottom chamber 3*a* of the boom cylinder 3 to flow to the downstream of the check valve 11 and prevents the backflow.

The control valve unit 4 further includes a first switching valve 40 and a second switching valve 41. The first switching valve 40 is coupled to the bottom chamber 3*a* of the boom cylinder 3 and switches according to the magnitude of the bottom pressure of the boom cylinder 3. The second switching valve 41 is disposed on the load detection circuit 131 and switches according to the magnitude of the pressure of the signal oil passage 107.

When the bottom pressure of the boom cylinder 3 is larger than a preset predetermined threshold a (hereinafter simply referred to as "threshold a"), the first switching valve 40 guides the boom lowering command pressure a generated by the operating device 122 to the pressure compensation valve 7 via the signal oil passage 107 and causes the boom lowering command pressure a to act in the closing direction of the pressure compensation valve 7. This allows preventing the pressure oil in the pressure oil supply passage 105 from flowing into the boom cylinder 3. When the bottom pressure of the boom cylinder 3 is smaller than the threshold $\alpha$, the first switching valve 40 performs switching such that the pressure oil in the signal oil passage 107 is discharged to the tank 20.

When the pressure of the signal oil passage 107 is smaller than a preset predetermined threshold $\beta$ (hereinafter simply referred to as "threshold $\beta$"), the second switching valve 41 guides the load pressure Pl detected by the load detection circuit 131 to the unloading valve 115 and the regulator 111. When the pressure of the signal oil passage 107 is larger than the threshold $\beta$, a tank pressure (almost 0 MPa) is guided to the unloading valve 115 and the regulator 111 as the load pressure Pl.

In this embodiment, The control valve unit 4 includes the first differential pressure control valve 201, which is located between the boom cylinder 3 (flow rate control valve 6) and the accumulator 300, and the second differential pressure control valve 202, which is located between the accumulator 300 and the tank 20.

When the pressure oil flows from the bottom chamber 3*a* of the boom cylinder 3 to the flow rate control valve 6, the first differential pressure control valve 201 performs control such that a differential pressure between the upstream pressure and the downstream pressure of the meter-out throttle 6*do* of the flow rate control valve 6 on the position d side (differential pressure between before and after the meter-out throttle 6*do*) becomes a predetermined target differential pressure (hereinafter simply referred to as "target differential pressure"). The second differential pressure control valve 202 performs control such that a differential pressure between the upstream pressure of the meter-out throttle 6*do* of the flow rate control valve 6 on the position d side and the downstream pressure of the first differential pressure control valve 201, that is, the differential pressure between the upstream pressure and the downstream pressure of the flow rate control valve 6 and the first differential pressure control valve 201 becomes the target differential pressure.

The respective first differential pressure control valve 201 and second differential pressure control valve 202 have load-dependent characteristics indicated by a solid line B in FIG. 4. Here, "load-dependent characteristics" mean characteristics where the target differential pressure changes so as to increase as the load (pressure) applied to the boom cylinder 3 increases.

Specifically, the first differential pressure control valve 201 is controlled such that the increase in the target differential pressure according to the increase in the bottom pressure of the boom cylinder 3 increases the differential pressure between before and after the meter-out throttle 6*do* of the flow rate control valve 6 on the position d side and increases the flow rate through the meter-out throttle 6*do*.

Similarly, the second differential pressure control valve 202 is controlled such that the increase in the target differential pressure according to the increase in the bottom pressure of the boom cylinder 3 increases the differential pressure between the upstream pressure (the bottom pressure of the boom cylinder 3) of the meter-out throttle 6*do* of the flow rate control valve 6 on the position d side and the downstream pressure of the first differential pressure control valve 201 and increases the flow rate through the meter-out throttle 6*do* and the first differential pressure control valve 201.

In this embodiment, the first differential pressure control valve 201 and the second differential pressure control valve 202 are the pressure compensation valves each including a first pressure receiving chamber and a second pressure receiving chamber. The first pressure receiving chamber causes a duct that couples the flow rate control valve 6 and the tank 20 together to act in a closing direction. The second pressure receiving chamber causes the duct that couples the flow rate control valve 6 and the tank 20 together to act in an open direction. Since the structure of the first differential pressure control valve 201 and the structure of the second differential pressure control valve 202 are similar, the following gives the description with an example of the structure of the first differential pressure control valve 201 with reference to FIG. 3.

As illustrated in FIG. 3, the first differential pressure control valve 201 includes a first pressure receiving chamber 201*a* and a second pressure receiving chamber 201*b*. The first pressure receiving chamber 201*a* causes a duct that flows the pressure oil discharged from the bottom chamber 3*a* of the boom cylinder 3 to the accumulator 300 and the second differential pressure control valve 202 via the flow rate control valve 6 to act in a closing direction. The second pressure receiving chamber 201*b* causes this duct to act in an open direction.

To the first pressure receiving chamber 201*a* actuating the duct in the closing direction, a bottom pressure Pb of the boom cylinder 3 (hereinafter simply referred to as "bottom pressure Pb") is applied (acts). To the second pressure receiving chamber 201*b* actuating the duct in the open direction, a downstream pressure Pz of the meter-out throttle 6*do* of the flow rate control valve 6 on the position d side is applied (acts). Then, the first pressure receiving chamber 201*a* has a pressure receiving area (first pressure receiving area Aa) configured smaller than a pressure receiving area (second pressure receiving area Ab) of the second pressure receiving chamber 201*b* (Aa<Ab).

Here, with a set pressure of the first differential pressure control valve 201 set to Pref, when a force from a spring 201*c* of the first differential pressure control valve 201 calculated based on this set pressure Pref is expressed by a spring force Fsp, a force acting on the second pressure receiving chamber 201*b* (a force acting in the open direction) Fo is found by the following Formula (1).

[Math. 1]

$$Fo=Pz\cdot Ab+Fsp \quad (1)$$

A force acting on the first pressure receiving chamber 201*a* (a force acting in the closing direction) Fc is found by the following Formula (2).

[Math. 2]

$$Fc=Pb\cdot Aa \quad (2)$$

Since Formula (1) and Formula (2) are balanced while the first differential pressure control valve 201 is controlled (Fo=Fc), the following Formula (3) is established.

[Math. 3]

$$Pz\cdot Ab+Fsp=Pb\cdot Aa \quad (3)$$

While the first differential pressure control valve 201 according to the embodiment uses the pressure compensation valves having the different areas, the first pressure receiving area Aa and the second pressure receiving area Ab (Aa<Ab), since the first pressure receiving area Aa and the second pressure receiving area Ab are equal (Aa=Ab) in the ordinary pressure compensation valves, modification of Formula (3) establishes the following Formula (4).

[Math. 4]

$$Pb-Pz=Fsp/Aa \quad (4)$$

In Formula (4), the left side (Pb−Pz) indicates the differential pressure between before and after the meter-out throttle 6*do* of the flow rate control valve 6 on the position d side and the right side (Fsp/Aa) is the set pressure Pref. Accordingly, in this case, the differential pressure (Pb−Pz) between before and after the meter-out throttle 6*do* of the flow rate control valve 6 on the position d side is controlled constantly so as to be Pref (target differential pressure). Note that Formula (4) is equivalent to a straight line indicated by a dashed line A in FIG. 4.

Meanwhile, the size of the first pressure receiving area Aa is smaller than that of the second pressure receiving area Ab (Aa<Ab) in the first differential pressure control valve 201 according to the embodiment, modification of Formula (3) establishes the following Formula (5).

[Math. 5]

$$Pb-Pz=Pb\cdot(1-Aa/Ab)+Fsp/Ab \quad (5)$$

From Formula (5), as Pb on the right side becomes large, the left side (Pb−Pz) becomes large (in proportion). Accordingly, the differential pressure (Pb−Pz) between before and after the meter-out throttle 6*do* of the flow rate control valve 6 on the position d side is controlled so as to increase according to the increase in the bottom pressure Pb. Note that Formula (5) is equivalent to a straight line indicated by a solid line B in FIG. 4.

Fsp/Ab on the right side indicates a set pressure Psp and Fsp/Ab is a constant determined by the spring force Fsp from the spring 201*c*. As illustrated in FIG. 4, this set pressure Psp is set such that the differential pressure (Pb−Pz) between before and after the meter-out throttle 6*do* of the flow rate control valve 6 on the position d side becomes the target differential pressure Pref when the boom cylinder 3 operates in the contracting direction while the bucket 407 is in an unladen state.

By thus configuring the magnitude relationship of the first pressure receiving area Aa of the first pressure receiving chamber 201*a* and the second pressure receiving area Ab of the second pressure receiving chamber 201*b* of the first differential pressure control valve 201 to Aa<Ab, the increase in the bottom pressure Pb increases the target differential pressure Pref; therefore, the flow rate through the meter-out throttle 6*do* of the flow rate control valve 6 on the position d side can be controlled to increase.

Similarly to the first differential pressure control valve 201, by configuring the first pressure receiving area smaller than the second pressure receiving area in the second differential pressure control valve 202, the increase in the bottom pressure Pb increases the target differential pressure; therefore, the flow rate through the meter-out throttle 6*do* of the flow rate control valve 6 on the position d side and the first differential pressure control valve 201 can be controlled to increase.

Here, the following describes a control method of the main pump 101. First, a differential pressure Pls (=Pp−Pl) between the load pressure Pl detected by the load detection circuit 131 and a delivery pressure Pp of the main pump 101 is compared with the target differential pressure Pref in small and large. In the case where the differential pressure Pls is larger than the target differential pressure Pref (Pls>Pref), the regulator 111 decreases a tilt (capacity) of the main pump 101. In the case where the differential pressure Pls is smaller than the target differential pressure Pref (Pls>Pref), the tilt (capacity) of the main pump 101 is increased (load-sensing control).

This load-sensing control can discharge a required flow rate according to the manipulated variable by the operating device 122, that is, only the pressure and flow rate required for the boom cylinder 3 from the main pump 101. Accordingly, an extra flow rate is less likely to be generated in the main pump 101 and therefore a heat generation and the like can be reduced, thereby ensuring operating the main pump 101 while the energy is saved.

As illustrated in FIG. 2, a pilot pressure oil supply passage 31*a* coupled to the pilot pump 30 includes a pilot relief valve 32 and a gate lock valve 100. The pilot relief valve 32 generates a constant pilot pressure in the pilot pressure oil supply passage 31*a*. The gate lock valve 100 switches a coupling destination for a pilot pressure oil supply passage 31*b* on the downstream side.

The gate lock valve 100 switches the coupling destination for the pilot pressure oil supply passage 31*b* on the downstream side whether to couple the pilot pressure oil supply passage 31*b* to the pilot pressure oil supply passage 31*a* or to the tank 20 using a gate lock lever 24. The operating device 122 is coupled to the pilot pressure oil supply passage 31*b* on the downstream side. The operating device 122 includes a pilot valve (pressure reducing valve) to generate operation pilot pressures (the boom lowering command pressure a and the boom rising command pressure b) to control the flow rate control valve 6.

(Operation of Hydraulic Driving Device 5)

Figure 5:
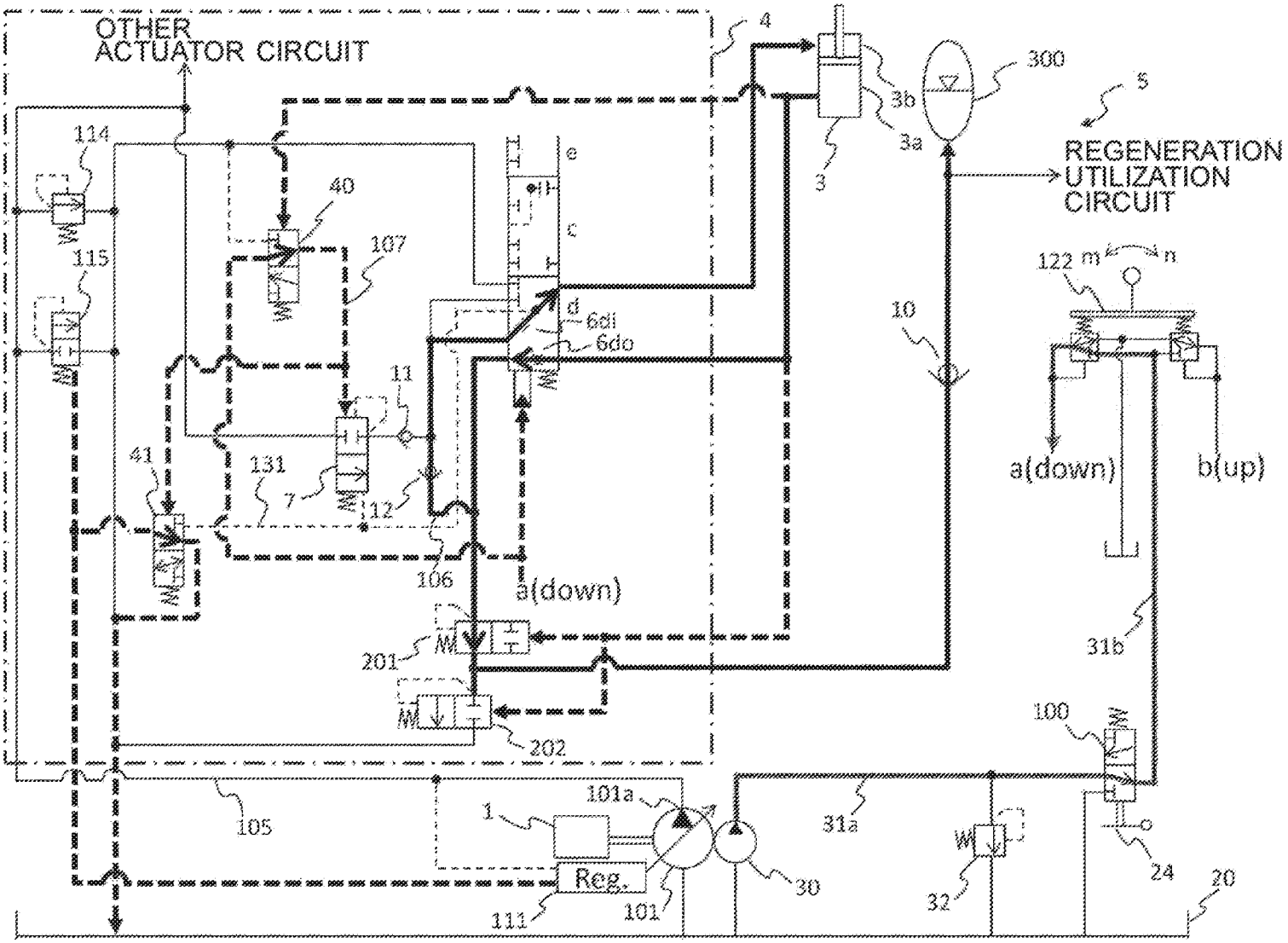
FIG. 5 is a drawing describing an operation of the hydraulic driving device when a boom lowering operation is performed in the air in a state where an accumulator is in an accumulable state.
Figure 6:
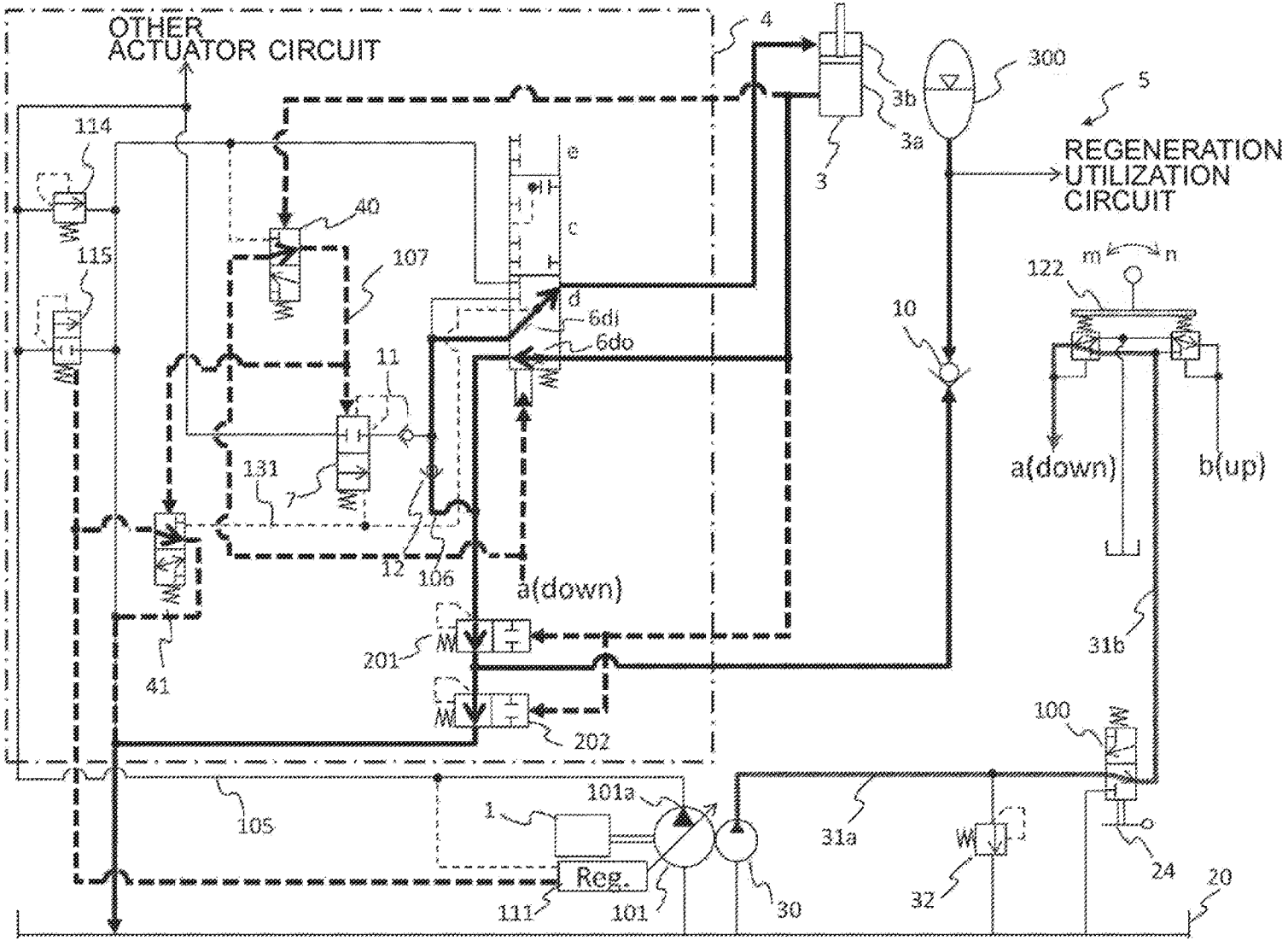
FIG. 6 is a drawing describing an operation of the hydraulic driving device when the boom lowering operation is performed in the air in a state where the accumulator is sufficiently accumulated.
Figure 7:
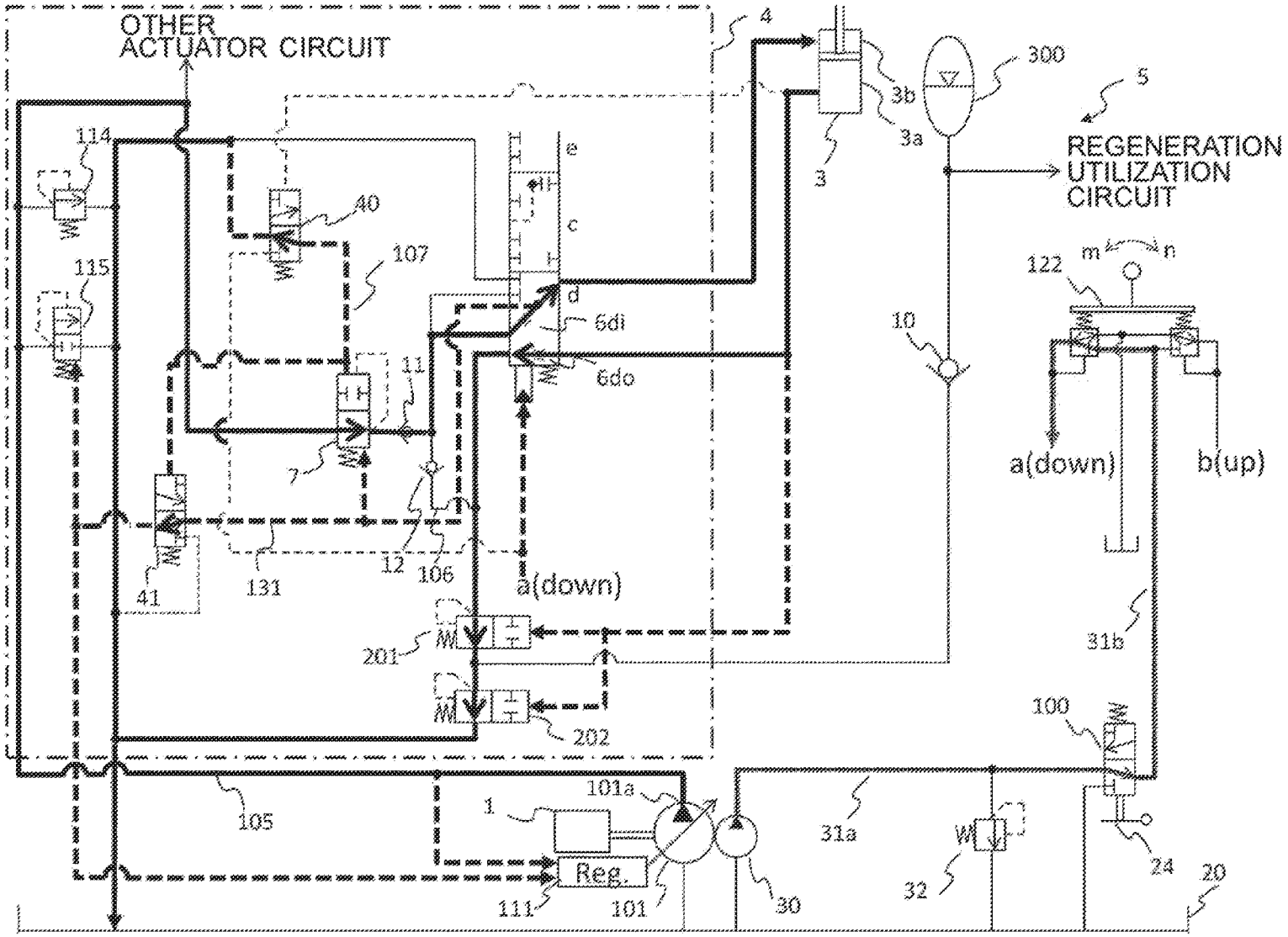
FIG. 7 is a drawing describing an operation of the hydraulic driving device when a body lift operation is performed.

Next, the following describes the operation of the hydraulic driving device 5 when the boom lowering operation is performed with reference to FIGS. 5 to 7.

FIG. 5 is a drawing describing an operation of the hydraulic driving device 5 when the boom lowering operation is performed in the air in a state where the accumulator 300 is in an accumulable state. FIG. 6 is a drawing describing an operation of the hydraulic driving device 5 when the boom lowering operation is performed in the air in a state where the accumulator 300 is sufficiently accumulated. FIG. 7 is a drawing describing an operation of the hydraulic driving device 5 when a body lift operation is performed. FIGS. 5 to 7 illustrate main lines where the pressure oil flows by bold lines.

As illustrated in FIGS. 5 to 7, to perform the boom lowering operation, the lever of the operating device 122 is operated in the m direction illustrated in FIGS. 5 to 7. The boom lowering command pressure a is generated according to the manipulated variable of the lever of the operating device 122, and this boom lowering command pressure a acts on one pressure receiving chamber of the flow rate control valve 6. Accordingly, the flow rate control valve 6 strokes up to the position d and the boom cylinder 3 drives in the contracting direction.

First, the following describes (a) the operation of the hydraulic driving device 5 when the boom lowering operation is performed in the air in the state where the bucket 407 is unladen and the accumulator 300 is in the accumulable state with reference to FIG. 5.

To perform the boom lowering operation in the air, since the bottom pressure Pb is larger than a switching threshold a of the first switching valve 40 (Pb>α), the first switching valve 40 switches so as to guide the boom lowering command pressure a to the signal oil passage 107. Thus, the boom lowering command pressure a acts on the pressure compensation valve 7, thereby ensuring preventing the pressure oil in the pressure oil supply passage 105 from flowing into the boom cylinder 3.

The pressure in the signal oil passage 107 switches the second switching valve 41 and the tank pressure (almost 0 MPa) is introduced to the unloading valve 115 and the regulator 111 as the load pressure Pl. The regulator 111 maintains the delivery pressure Pp of the main pump 101 to the pressure (unloading valve set pressure) found by adding a set pressure Pun0 of the spring of the unloading valve 115 to the tank pressure. Usually, the set pressure Pun0 of the spring of the unloading valve 115 is set slightly higher than the target differential pressure Pref (Pun0>Pref).

The differential pressure Pls between the delivery pressure Pp of the main pump 101 and the load pressure Pl becomes Pls=Pp−0=Pun0 (>Pref); therefore, the regulator 111 performs control so as to decrease the tilt of the main pump 101 to maintain the capacity of the main pump 101 to the minimum.

Since the boom cylinder 3 drives in the contracting direction by the boom lowering command pressure a, a part of the pressure oil (hereinafter simply referred to as "discharge oil") discharged from the bottom chamber 3*a* of the boom cylinder 3 flows into the rod chamber 3*b* of the boom cylinder 3 via the meter-out throttle 6*do* of the flow rate control valve 6 on the position d side, the regeneration oil passage 106, the check valve 12, and the meter-in throttle 6*di* of the flow rate control valve 6 on the position d side. The remaining discharge oil is guided to the accumulator 300 and the second differential pressure control valve 202 via the first differential pressure control valve 201.

Here, since the bucket 407 is in the unladen state, the target differential pressures of the respective first differential pressure control valve 201 and second differential pressure control valve 202 become the target differential pressures Pref. Since the accumulator 300 is in the accumulable state, the first differential pressure control valve 201 is actuated such that the differential pressure (Pb−Pz) between before and after the meter-out throttle 6*do* of the flow rate control valve 6 on the position d side becomes the target differential pressure Pref. This maintains the cylinder speed of the boom cylinder 3 at the target speed according to the opening area of the meter-out throttle 6*do*. At this time, the opening of the first differential pressure control valve 201 is throttled to control the differential pressure between before and after the meter-out throttle 6*do*, and a differential pressure ΔP occurs between before and after the first differential pressure control valve 201.

The second differential pressure control valve 202 is actuated such that the differential pressure Pd between the upstream pressure Pb (bottom pressure Pb) of the meter-out throttle 6*do* and a downstream pressure Pz1 of the first differential pressure control valve 201 becomes the target differential pressure Pref. Accordingly, the differential pressure Pd between the upstream pressure Pb of the meter-out throttle 6*do* and the downstream pressure Pz1 of the first differential pressure control valve 201 becomes Pd=Pb−Pz1=Pref+ΔP (>Pref) and the second differential pressure control valve 202 is actuated to be fully closed.

In view of this, as illustrated in FIG. 5, the discharge oil does not flow to the tank 20 but is accumulated in the accumulator 300. Accordingly, when the boom lowering operation is performed in the air in the state where the bucket 407 is unladen and the accumulator 300 is in the accumulable state, the boom cylinder 3 can be operated at the cylinder speed determined by the target differential pressure Pref while the energy is accumulated in the accumulator 300 in the boom lowering operation.

Next, the following describes (b) the operation of the hydraulic driving device 5 when the boom lowering operation is performed in the air in the state where the bucket 407 is unladen and the accumulator 300 is sufficiently accumulated with reference to FIG. 6.

In the case (b), as illustrated in FIG. 6, since the accumulator 300 is sufficiently accumulated and the pressure inside the accumulator 300 is high, an action of a check valve 10 avoids the discharge oil to flow into the accumulator 300. This point is different from the case (a).

At this time, although the first differential pressure control valve 201 opens to the maximum, in this case, the differential pressure (Pb−Pz) between before and after the meter-out throttle 6*do* of the flow rate control valve 6 on the position d side becomes smaller than the target differential pressure Pref (Pb−Pz<Pref). Since the opening of the first differential pressure control valve 201 is sufficiently large, the differential pressure is not generated and the differential pressure ΔP between before and after the first differential pressure control valve 201 becomes almost 0 (ΔP≈0).

Accordingly, the differential pressure Pd between the upstream pressure Pb of the meter-out throttle 6*do* and the downstream pressure Pz1 of the first differential pressure control valve 201 becomes Pd=Pb−Pz1=less than Pref+ΔP (<Pref), and the second differential pressure control valve 202 opens to be actuated such that the differential pressure Pd between the upstream pressure Pb of the meter-out throttle 6*do* and the downstream pressure Pz1 of the first differential pressure control valve 201 becomes the target differential pressure Pref.

At this time, since the first differential pressure control valve 201 opens to the maximum and the differential pressure ΔP is almost 0, the differential pressure (Pb−Pz) between before and after the meter-out throttle 6*do* is controlled at the target differential pressure Pref and the cylinder speed of the boom cylinder 3 is maintained at the target speed according to the opening area of the meter-out throttle 6*do*. Accordingly, even when the boom lowering operation is performed in the air in the state where the bucket 407 is unladen and the accumulator 300 is sufficiently accumulated, the boom cylinder 3 can be operated at the cylinder speed determined by the target differential pressure Pref.

Next, the following describes (c) the operation of the hydraulic driving device 5 when the boom lowering operation is performed in the air in the state where a burden lifted by the bucket 407 applies a load weight to the front working device 404 and the accumulator 300 is in the accumulable state with reference to FIG. 5.

In the case (c), since the accumulator 300 is in the accumulable state, although the main flow of the pressure oil is as illustrated in FIG. 5 similarly to the case (a), the point that the burden on the bucket 407 is lifted and the load weight is applied to the front working device 404 is different from the case (a).

Specifically, the bottom pressure Pb becomes larger than that of the case (a) (unladen state). Since the respective first differential pressure control valve 201 and second differential pressure control valve 202 have the load-dependent characteristics, from the above-described Formula (5), the respective target differential pressures of the first differential pressure control valve 201 and the second differential pressure control valve 202 become Prefd, a value larger than Pref according to the increase in the bottom pressure Pb (Prefd>Pref).

Since the accumulator 300 is in the accumulable state, the first differential pressure control valve 201 is actuated such that the differential pressure (Pb−Pz) between before and after the meter-out throttle 6*do* of the flow rate control valve 6 on the position d side becomes the target differential pressure Prefd. This maintains the cylinder speed of the boom cylinder 3 at the target speed according to the opening area of the meter-out throttle 6*do*.

At this time, similarly to the case (a), the opening of the first differential pressure control valve 201 is throttled to control the differential pressure (Pb−Pz) between before and after the meter-out throttle 6*do*, and the differential pressure ΔP occurs between before and after the first differential pressure control valve 201.

The second differential pressure control valve 202 is actuated such that the differential pressure Pd between the upstream pressure Pb (bottom pressure Pb) of the meter-out throttle 6*do* and the downstream pressure Pz1 of the first differential pressure control valve 201 becomes the target differential pressure Prefd. Accordingly, the differential pressure Pd between the upstream pressure Pb of the meter-out throttle 6*do* and the downstream pressure Pz1 of the first differential pressure control valve 201 becomes Pd=Pb−Pz1=Prefd+ΔP (>Prefd) and the second differential pressure control valve 202 is actuated to be fully closed.

In view of this, as illustrated in FIG. 5, the discharge oil does not flow to the tank 20 but is accumulated in the accumulator 300. Accordingly, when the boom lowering operation is performed in the air in the state where the burden lifted by the bucket 407 applies the load weight to the front working device 404 and the accumulator 300 is in the accumulable state, the boom cylinder 3 can be operated at the cylinder speed determined by the target differential pressure Prefd while the energy is accumulated in the accumulator 300 in the boom lowering operation.

As described above, the target differential pressure Prefd is larger than the target differential pressure Pref in the unladen state (Prefd>Pref), with the burden loaded on the bucket 407, the flow rate through the meter-out throttle 6*do* of the flow rate control valve 6 on the position d side becomes larger than that in the unladen state and the cylinder speed of the boom cylinder 3 also increases.

Thus, since the cylinder speed of the boom cylinder 3 becomes fast according to the increase in the load weight applied to the boom cylinder 3, the hydraulic driving device 5 including the accumulator 300 can also have the operability meeting the general recognition of the operator that the front working device 404 having a heavy burden falls down faster than the case where the front working device 404 is unladen.

Next, the following describes (d) the operation of the hydraulic driving device 5 when the boom lowering operation is performed in the air in the state where the burden lifted by the bucket 407 applies the load weight to the front working device 404 and the accumulator 300 is sufficiently accumulated with reference to FIG. 6.

In the case (d), since the accumulator 300 is in the sufficiently accumulated state, although the main flow of the pressure oil is as illustrated in FIG. 6 similarly to the case (b), the point that the burden on the bucket 407 is lifted and the load weight is applied to the front working device 404 is different from the case (b).

Specifically, the bottom pressure Pb becomes larger than that of the case (b) (unladen state). Since the respective first differential pressure control valve 201 and second differential pressure control valve 202 have the load-dependent characteristics, from the above-described Formula (5), the respective target differential pressures of the first differential pressure control valve 201 and the second differential pressure control valve 202 become Prefd, a value larger than Pref according to the magnitude of the bottom pressure Pb. This is similar to the case (c).

As illustrated in FIG. 6, since the accumulator 300 is sufficiently accumulated and the pressure inside the accumulator 300 is high, the action of the check valve 10 avoids the discharge oil to flow into the accumulator 300. This point is different from the case (c).

At this time, although the first differential pressure control valve 201 opens to the maximum, in this case, the differential pressure (Pb−Pz) between before and after the meter-out throttle 6*do* of the flow rate control valve 6 on the position d side becomes smaller than the target differential pressure Prefd (Pb−Pz<Prefd). Since the opening of the first differential pressure control valve 201 is sufficiently large, the differential pressure is not generated and the differential pressure ΔP between before and after the first differential pressure control valve 201 becomes almost 0 (ΔP≈0).

Accordingly, the differential pressure Pd between the upstream pressure Pb of the meter-out throttle 6*do* and the downstream pressure Pz1 of the first differential pressure control valve 201 becomes Pd=Pb−Pz1=less than Prefd+ΔP (<Prefd), and the second differential pressure control valve 202 opens to be actuated such that the differential pressure Pd between the upstream pressure Pb of the meter-out throttle 6*do* and the downstream pressure Pz1 of the first differential pressure control valve 201 becomes the target differential pressure Prefd.

At this time, since the first differential pressure control valve 201 opens to the maximum and the differential pressure ΔP is almost 0, the differential pressure (Pb−Pz) between before and after the meter-out throttle 6*do* is controlled at the target differential pressure Prefd and the cylinder speed of the boom cylinder 3 is maintained at the target speed according to the opening area of the meter-out throttle 6*do*. Accordingly, even when the boom lowering operation is performed in the air in the state where the burden lifted by the bucket 407 applies the load weight to the front working device 404 and the accumulator 300 is sufficiently accumulated, the boom cylinder 3 can be operated at the cylinder speed determined by the target differential pressure Prefd.

Similarly to the case (c), the target differential pressure Prefd is larger than the target differential pressure Pref in the unladen state (Prefd>Pref), with the burden loaded on the bucket 407, the flow rate through the meter-out throttle 6*do* of the flow rate control valve 6 on the position d side becomes larger than that in the unladen state and the cylinder speed of the boom cylinder 3 also becomes fast.

Thus, in the case (d), similarly to the case (c), since the cylinder speed of the boom cylinder 3 becomes fast according to the increase in the load weight applied to the boom cylinder 3, the hydraulic driving device 5 including the accumulator 300 can also have the operability meeting the general recognition of the operator that the front working device 404 having a heavy burden falls down faster than the case where the front working device 404 is unladen.

Next, the following describes (e) the operation of the hydraulic driving device 5 when a heavy load occurs in the rod chamber 3*b* of the boom cylinder 3 (when the body lift operation is performed) at the boom lowering operation with reference to FIG. 7.

When the heavy load occurs in the rod chamber 3*b* of the boom cylinder 3 at the boom lowering operation, the bottom pressure Pb becomes smaller than the switching threshold a of the first switching valve 40 (Pb<α), the pressure oil in the signal oil passage 107 is introduced to the tank 20.

Accordingly, the pressure of the signal oil passage 107 becomes the tank pressure (almost 0 MPa); therefore, the pressure compensation valve 7 performs pressure compensation control such that the differential pressure between before and after the meter-in throttle 6*di* of the flow rate control valve 6 on the position d side becomes constant. The second switching valve 41 guides the load pressure Pl detected by the load detection circuit 131 to the unloading valve 115 and the regulator 111.

The regulator 111 increases the delivery pressure Pp of the main pump 101 to be a pressure found by adding the target differential pressure Pref to the load pressure Pl, and the unloading valve set pressure of the unloading valve 115 increases to a pressure found by adding the set pressure Pun0 of the spring of the unloading valve 115 to the load pressure Pl. This cuts off the oil passage that discharges the pressure oil in the pressure oil supply passage 105 to the tank 20.

In this case, the bottom pressure Pb is smaller than the load pressure Pl detected by the load detection circuit 131 (Pb<Pl), and the upstream pressure of the meter-in throttle 6*di* of the flow rate control valve 6 on the position d side is larger than the load pressure Pl; therefore, the discharge oil cannot pass through the check valve 12 and all flow rate is guided to the first differential pressure control valve 201.

Since the bottom pressure Pb becomes smaller than the set pressure determined by the respective springs of the first differential pressure control valve 201 and the second differential pressure control valve 202, the respective first differential pressure control valve 201 and second differential pressure control valve 202 stroke in the open direction by the forces from the springs and the discharge oil is discharged to the tank 20. Thus, the first differential pressure control valve 201 and the second differential pressure control valve 202 are actuated so as to discharge the discharge oil to tank 20 even when the load occurs at the boom lowering operation; therefore, the body lift operation can be performed.

Second Embodiment

Figure 8:
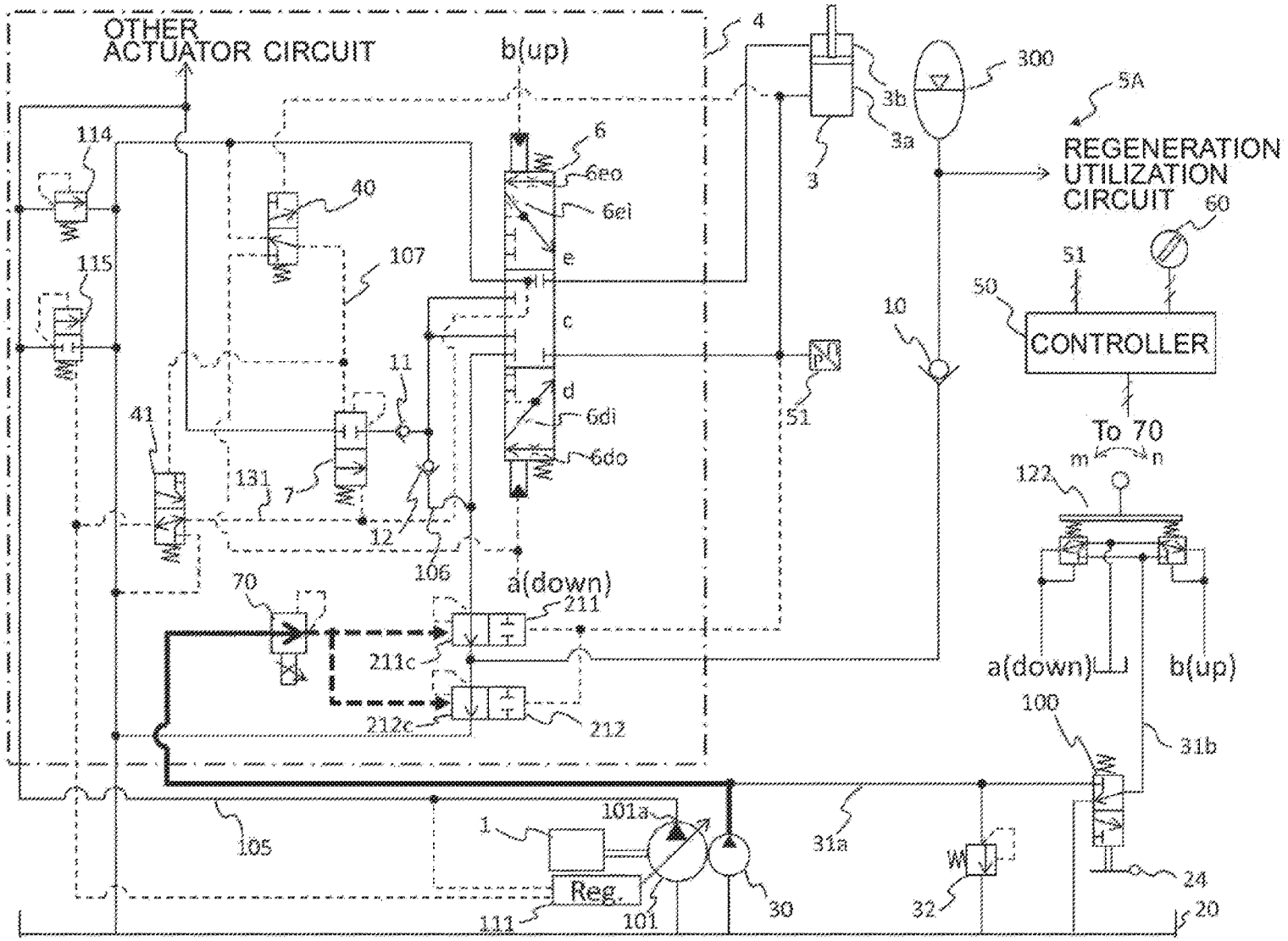
FIG. 8 is a drawing illustrating a configuration of the hydraulic driving device according to a second embodiment of the present invention.
Figure 9:
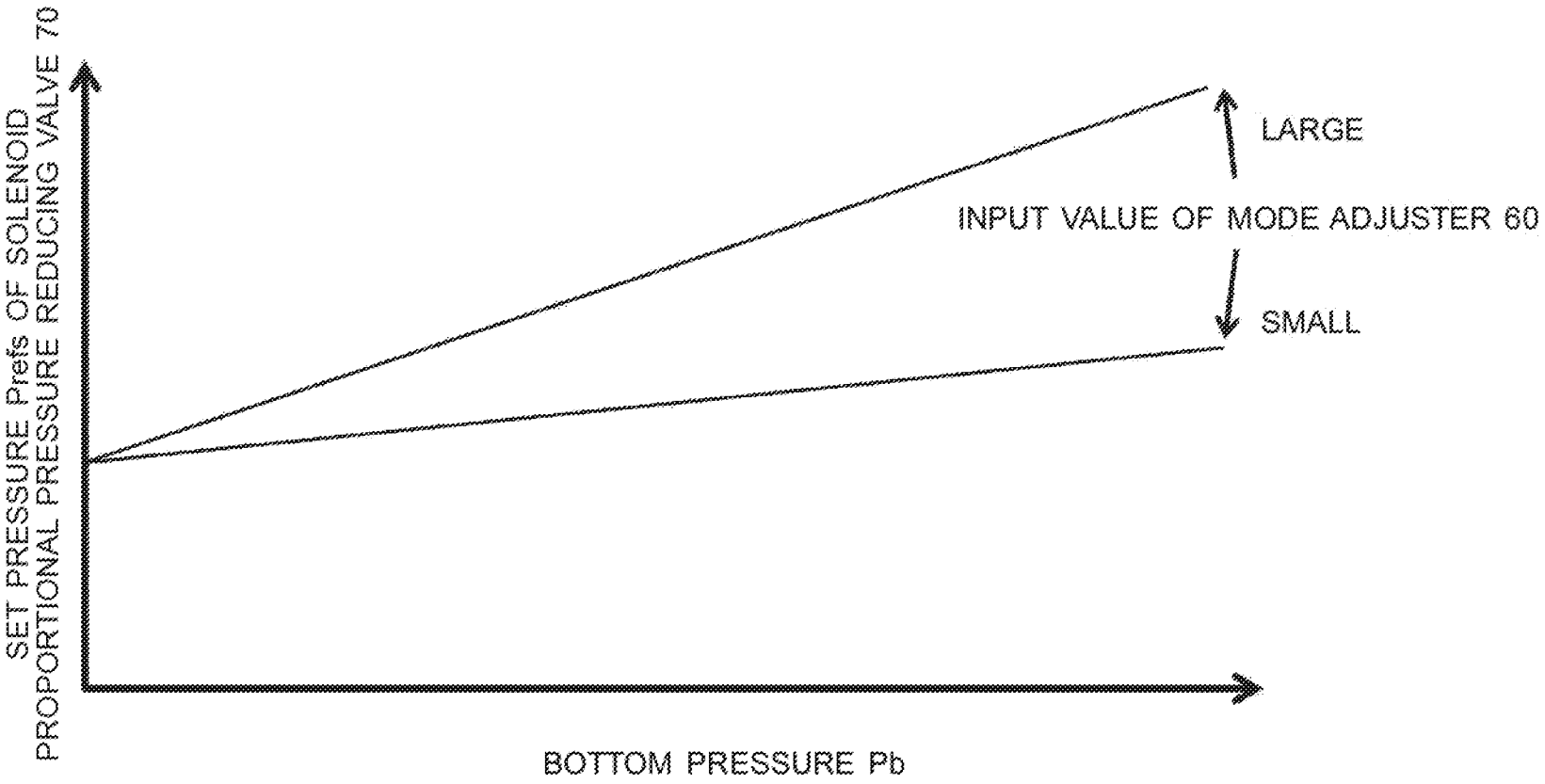
FIG. 9 is a drawing describing a relationship between a bottom pressure of a boom cylinder and a set pressure of a solenoid proportional pressure reducing valve.

Next, the following describes a hydraulic driving device 5A according to the second embodiment of the present invention with reference to FIG. 8 and FIG. 9.

FIG. 8 is a drawing illustrating the configuration of the hydraulic driving device 5A according to the second embodiment. FIG. 9 is a drawing describing a relationship between the bottom pressure Pb of the boom cylinder 3 and a set pressure Prefs of a solenoid proportional pressure reducing valve 70. In FIG. 8 and FIG. 9, like identical reference numerals designate elements in common with those in the description for the hydraulic driving device 5 according to the first embodiment, and therefore such elements will not be further elaborated here. The same applies to the following third embodiment.

(Configuration of Hydraulic Driving Device 5A)

First, the following describes the configuration of the hydraulic driving device 5A.

The hydraulic driving device 5A according to the embodiment includes a first differential pressure control valve 211 and a second differential pressure control valve 212 similarly to the hydraulic driving device 5 according to the first embodiment. However, different from the configuration of the first differential pressure control valve 201 and the configuration of the second differential pressure control valve 202 according to the first embodiment, the respective first differential pressure control valve 211 and second differential pressure control valve 212 are pressure compensation valves where a first pressure receiving area of a first pressure receiving chamber is set equal to a second pressure receiving area of a second pressure receiving chamber.

As illustrated in FIG. 8, the control valve unit 4 includes the solenoid proportional pressure reducing valve 70 as a pressure reducing valve having a primary side coupled to the pilot pump 30 (pilot pressure oil supply passage 31*a*) and a secondary side coupled to respective third pressure receiving chamber 211*c* and third pressure receiving chamber 212*c*. The third pressure receiving chamber 211*c* can cause the pressure to act in a direction identical to that of the second pressure receiving chamber of the first differential pressure control valve 211. The third pressure receiving chamber 212*c* can cause the pressure to act in a direction identical to that of the second pressure receiving chamber of the second differential pressure control valve 212.

This solenoid proportional pressure reducing valve 70 outputs a set pressure Prefs determined according to a magnitude of an electrical signal to the secondary side as the output pressure Prefs (signal pressure Prefs) and guides the output pressure Prefs to the respective third pressure receiving chamber 211*c* of the first differential pressure control valve 211 and third pressure receiving chamber 212*c* of the second differential pressure control valve 212.

The hydraulic driving device 5A includes a mode adjuster 60, a first pressure sensor 51, and a controller 50. The mode adjuster 60 is an adjuster that can perform adjustment by an operation by the operator. The first pressure sensor 51 detects the bottom pressure Pb. The controller 50 outputs the electrical signal to the solenoid proportional pressure reducing valve 70 according to a signal from the mode adjuster 60 and a signal from the first pressure sensor 51. The mode adjuster 60 changes an increased amount of the output pressure Prefs to the secondary side from the solenoid proportional pressure reducing valve 70 according to the manipulated variable by the operator.

As illustrated in FIG. 9, the set pressure Prefs of the solenoid proportional pressure reducing valve 70 has a property that changes to increase as the bottom pressure Pb detected by the first pressure sensor 51 increases (in proportion). The controller 50 outputs a command value in accordance with the property to the solenoid proportional pressure reducing valve 70.

At this time, as illustrated in FIG. 9, the gradient of increase in the set pressure Prefs of the solenoid proportional pressure reducing valve 70 (the gradient of the straight line illustrated in FIG. 9) is determined by the signal from the mode adjuster 60. As the signal value from the mode adjuster 60 increases, the proportion (gradient) of the amount of change of the set pressure Prefs of the solenoid proportional pressure reducing valve 70 relative to the amount of change of the bottom pressure Pb increases.

The solenoid proportional pressure reducing valve 70 outputs the output pressure Prefs in accordance with the output value from the controller 50. Then, this output pressure Prefs is guided to the respective third pressure receiving chamber 211*c* of the first differential pressure control valve 211 and third pressure receiving chamber 212*c* of the second differential pressure control valve 212.

The first differential pressure control valve 211 performs control such that the differential pressure (Pb−Pz) between before and after the meter-out throttle 6*do* of the flow rate control valve 6 on the position d side becomes the output pressure Prefs. The second differential pressure control valve 212 performs control such that the differential pressure Pd between the upstream pressure Pb of the meter-out throttle 6*do* and the downstream pressure Pz1 of the first differential pressure control valve 211 becomes the output pressure Prefs.

As described above, the output pressure Prefs is determined according to the bottom pressure Pb, and the output pressure Prefs increases according to the increase in the bottom pressure Pb. Therefore, the respective first differential pressure control valve 211 and second differential pressure control valve 212 have the load-dependent characteristics that the target differential pressures increase according to the bottom pressure Pb of the boom cylinder 3. This load-dependent characteristic changes based on the signal from the mode adjuster 60.

(Operation of Hydraulic Driving Device 5A)

Next, the following describes the operation of the hydraulic driving device 5A. Note that the operation of the hydraulic driving device 5A is similar to the operation of the hydraulic driving device 5 in the cases (a) to (e) described in the first embodiment except for the operations related to the solenoid proportional pressure reducing valve 70.

First, (a) when the boom lowering operation is performed in the air in the state where the bucket 407 is unladen and the accumulator 300 is in the accumulable state, the solenoid proportional pressure reducing valve 70 outputs an output pressure Prefs1 determined according to the bottom pressure Pb detected by the first pressure sensor 51 and the adjustment amount by the mode adjuster 60 to the secondary side.

The output pressure Prefs1 output from the solenoid proportional pressure reducing valve 70 is guided to the respective third pressure receiving chamber 211*c* of the first differential pressure control valve 211 and third pressure receiving chamber 212*c* of the second differential pressure control valve 212, and the respective target differential pressures of the first differential pressure control valve 211 and the second differential pressure control valve 212 become Prefs1.

Similarly to the case (a) described in the first embodiment, the differential pressure Pd between the upstream pressure Pb of the meter-out throttle 6*do* of the flow rate control valve 6 on the position d side and the downstream pressure Pz1 of the first differential pressure control valve 211 becomes Pd=Pb−Pz1=Prefs1+ΔP (>Prefs1); therefore, the second differential pressure control valve 212 is actuated to be fully closed.

In view of this, the discharge oil does not flow to the tank 20 but is accumulated in the accumulator 300. Accordingly, when the boom lowering operation is performed in the air in the state where the bucket 407 is unladen and the accumulator 300 is in the accumulable state, the boom cylinder 3 can be operated at the cylinder speed determined by the target differential pressure Prefs1 while the energy is accumulated in the accumulator 300 in the boom lowering operation.

Next, (b) when the boom lowering operation is performed in the air in the state where the bucket 407 is unladen and the accumulator 300 is sufficiently accumulated, similarly to the case (a) of this embodiment, the solenoid proportional pressure reducing valve 70 outputs the output pressure Prefs1 determined according to the bottom pressure Pb detected by the first pressure sensor 51 and the adjustment amount by the mode adjuster 60.

The output pressure Prefs1 output from the solenoid proportional pressure reducing valve 70 is guided to the respective third pressure receiving chamber 211*c* of the first differential pressure control valve 211 and third pressure receiving chamber 212*c* of the second differential pressure control valve 212, and the respective target differential pressures of the first differential pressure control valve 211 and the second differential pressure control valve 212 become Prefs1.

Similarly to the case (b) described in the first embodiment, the differential pressure Pd between the upstream pressure Pb of the meter-out throttle 6*do* of the flow rate control valve 6 on the position d side and the downstream pressure Pz1 of the first differential pressure control valve 211 becomes Pd=Pb−Pz1=less than Prefs1+ΔP (<Prefs1), and the second differential pressure control valve 212 opens to be actuated such that the differential pressure Pd between the upstream pressure Pb of the meter-out throttle 6*do* and the downstream pressure Pz1 of the first differential pressure control valve 211 becomes the target differential pressure Prefs1.

At this time, since the first differential pressure control valve 211 opens to the maximum and the differential pressure ΔP is almost 0, the differential pressure (Pb−Pz) between before and after the meter-out throttle 6*do* is controlled at the target differential pressure Prefs1 and the cylinder speed of the boom cylinder 3 is maintained at the target speed according to the opening area of the meter-out throttle 6*do*. Accordingly, even when the boom lowering operation is performed in the air in the state where the bucket 407 is unladen and the accumulator 300 is sufficiently accumulated, the boom cylinder 3 can be operated at the cylinder speed determined by the target differential pressure Prefs1.

Next, (c) when the boom lowering operation is performed in the air in the state where the burden lifted by the bucket 407 applies the load weight to the front working device 404 and the accumulator 300 is in the accumulable state, the solenoid proportional pressure reducing valve 70 outputs an output pressure Prefs2 determined according to the bottom pressure Pb detected by the first pressure sensor 51 and the adjustment amount by the mode adjuster 60. This output pressure Prefs2 is a value larger than the above-described output pressure Prefs1 (Prefs2>Prefs1).

The output pressure Prefs2 output from the solenoid proportional pressure reducing valve 70 is guided to the respective third pressure receiving chamber 211*c* of the first differential pressure control valve 211 and third pressure receiving chamber 212*c* of the second differential pressure control valve 212, and the respective target differential pressures of the first differential pressure control valve 211 and the second differential pressure control valve 212 become Prefs2.

Similarly to the case (c) described in the first embodiment, the differential pressure Pd between the upstream pressure Pb of the meter-out throttle 6*do* and the downstream pressure Pz1 of the first differential pressure control valve 211 becomes Pd=Pb−Pz1=Prefs2+ΔP (>Prefs2); therefore, the second differential pressure control valve 212 is actuated to be fully closed.

In view of this, the discharge oil does not flow to the tank 20 but is accumulated in the accumulator 300. Accordingly, when the boom lowering operation is performed in the air in the state where the burden lifted by the bucket 407 applies the load weight to the front working device 404 and the accumulator 300 is in the accumulable state, the boom cylinder 3 can be operated at the cylinder speed determined by the target differential pressure Prefs2 while the energy is accumulated in the accumulator 300 in the boom lowering operation.

As described above, the target differential pressure Prefs2 is larger than the target differential pressure Prefs1 in the unladen state (Prefs2>Prefs1), with the burden loaded on the bucket 407, the flow rate through the meter-out throttle 6*do* of the flow rate control valve 6 on the position d side becomes larger than that in the unladen state and the cylinder speed of the boom cylinder 3 also becomes fast.

Thus, since the cylinder speed of the boom cylinder 3 becomes fast according to the increase in the load weight applied to the boom cylinder 3, similarly to the first embodiment, the hydraulic driving device 5A including the accumulator 300 can also have the operability meeting the general recognition of the operator that the front working device 404 having the heavy burden falls down faster than the case where the front working device 404 is unladen.

Next, (d) when the boom lowering operation is performed in the air in the state where the burden lifted by the bucket 407 applies the load weight to the front working device 404 and the accumulator 300 is sufficiently accumulated, the solenoid proportional pressure reducing valve 70 outputs the output pressure Prefs2 determined according to the bottom pressure Pb detected by the first pressure sensor 51 and the adjustment amount by the mode adjuster 60 similarly to the case (c) of this embodiment. This output pressure Prefs2 is a value larger than the above-described output pressure Prefs1 (Prefs2>Prefs1).

The output pressure Prefs2 output from the solenoid proportional pressure reducing valve 70 is guided to the respective third pressure receiving chamber 211*c* of the first differential pressure control valve 211 and third pressure receiving chamber 212*c* of the second differential pressure control valve 212, and the respective target differential pressures of the first differential pressure control valve 211 and the second differential pressure control valve 212 become Prefs2.

Similarly to the case (d) described in the first embodiment, the differential pressure Pd between the upstream pressure Pb of the meter-out throttle 6*do* and the downstream pressure Pz1 of the first differential pressure control valve 211 becomes Pd=Pb−Pz1=less than Prefs2+ΔP (<Prefs2), and the second differential pressure control valve 212 opens to be actuated such that the differential pressure Pd between the upstream pressure Pb of the meter-out throttle 6*do* and the downstream pressure Pz1 of the first differential pressure control valve 211 becomes the target differential pressure Prefs2.

At this time, since the first differential pressure control valve 211 opens to the maximum and the differential pressure ΔP is almost 0, the differential pressure (Pb−Pz) between before and after the meter-out throttle 6*do* is controlled at the target differential pressure Prefs2 and the cylinder speed of the boom cylinder 3 is maintained at the target speed according to the opening area of the meter-out throttle 6*do*. Accordingly, even when the boom lowering operation is performed in the air in the state where the burden lifted by the bucket 407 applies the load weight to the front working device 404 and the accumulator 300 is sufficiently accumulated, the boom cylinder 3 can be operated at the cylinder speed determined by the target differential pressure Prefs2.

Similarly to the case (c) of this embodiment, the target differential pressure Prefs2 is larger than the target differential pressure Prefs1 in the unladen state (Prefs2>Prefs1); therefore, the flow rate through the meter-out throttle 6*do* of the flow rate control valve 6 on the position d side becomes large and the cylinder speed of the boom cylinder 3 also becomes fast.

Thus, since the cylinder speed of the boom cylinder 3 becomes fast according to the increase in the load weight applied to the boom cylinder 3, in the case (d) of this embodiment, the hydraulic driving device 5A including the accumulator 300 can also have the operability meeting the general recognition of the operator that the front working device 404 having the heavy burden falls down faster than the case where the front working device 404 is unladen similarly to the case (c).

By adjusting the mode adjuster 60 such that a value larger than the values of the output signals in the cases (a) to (d) in this embodiment is output, Prefs3, a value larger than the target differential pressure Prefs2 in the cases (c) and (d) where the burden is loaded on the bucket 407, becomes the target differential pressure (Prefs3>Prefs2). This allows the cylinder speed of the boom cylinder 3 to be faster than the cylinder speeds in the cases (c) and (d).

On the contrary, by adjusting the mode adjuster 60 such that a value smaller than the values of the output signals in the cases (a) to (d) in this embodiment is output, Prefs4, a value smaller than the target differential pressure Prefs2 in the cases (c) and (d) where the burden is loaded on the bucket 407, becomes the target differential pressure (Prefs4<Prefs2). This allows the cylinder speed of the boom cylinder 3 to be slower than the cylinder speeds in the cases (c) and (d).

Thus changing the adjustment amount of the mode adjuster 60 allows obtaining any property to which the operator's intention has been reflected, providing good operability. When an attachment such as a grapple is mounted instead of the bucket 407, since the grapple itself has a certain amount of weight, the load weight applied to the entire front working device 404 increases. Accordingly, even when the burden is not grasped with the grapple, performing the boom lowering operation increases the cylinder speed of the boom cylinder 3, possibly making a precise work difficult. However, the mode adjuster 60 can adjust the load-dependent characteristic in this case as well, the flexible operability can be secured.

Next, (e) when a heavy load occurs in the rod chamber 3*b* of the boom cylinder 3 (when the body lift operation is performed) at the boom lowering operation, the solenoid proportional pressure reducing valve 70 outputs an output pressure Prefs5 determined according to the bottom pressure Pb detected by the first pressure sensor 51 and the adjustment amount by the mode adjuster 60. This output pressure Prefs5 is a value smaller than the target differential pressure Prefs1 in the unladen state (Prefs5<Prefs1).

The output pressure Prefs5 output from the solenoid proportional pressure reducing valve 70 is guided to the respective third pressure receiving chamber 211*c* of the first differential pressure control valve 211 and third pressure receiving chamber 212*c* of the second differential pressure control valve 212, and the respective target differential pressures of the first differential pressure control valve 211 and the second differential pressure control valve 212 become Prefs5.

In this case, since the bottom pressure Pb becomes smaller than the output pressure Prefs5 (Pb<Prefs5), the respective first differential pressure control valve 211 and second differential pressure control valve 212 stroke in the open direction by the signal pressure and the discharge oil is discharged to the tank 20. Thus, the first differential pressure control valve 211 and the second differential pressure control valve 212 are actuated so as to discharge the discharge oil to the tank 20 even when the load occurs in the boom lowering operation; therefore, the body lift operation can be performed.

Third Embodiment

Next, the following describes a hydraulic driving device 5B according to the third embodiment of the present invention with reference to FIGS. 10 to 13.

(Configuration of Hydraulic Driving Device 5B)

Figure 10:
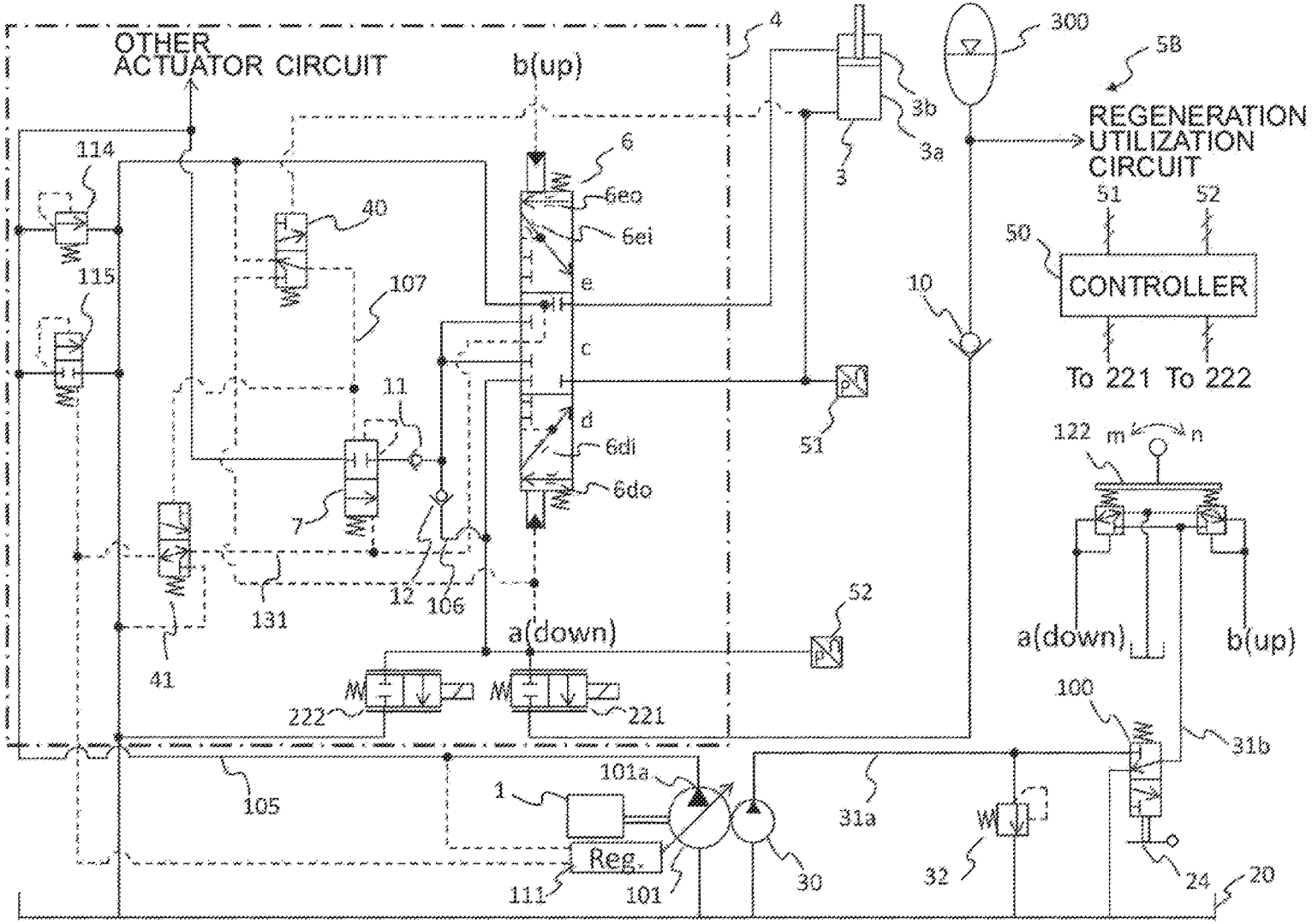
FIG. 10 is a drawing illustrating a configuration of a hydraulic driving device according to a third embodiment of the present invention.
Figure 11:
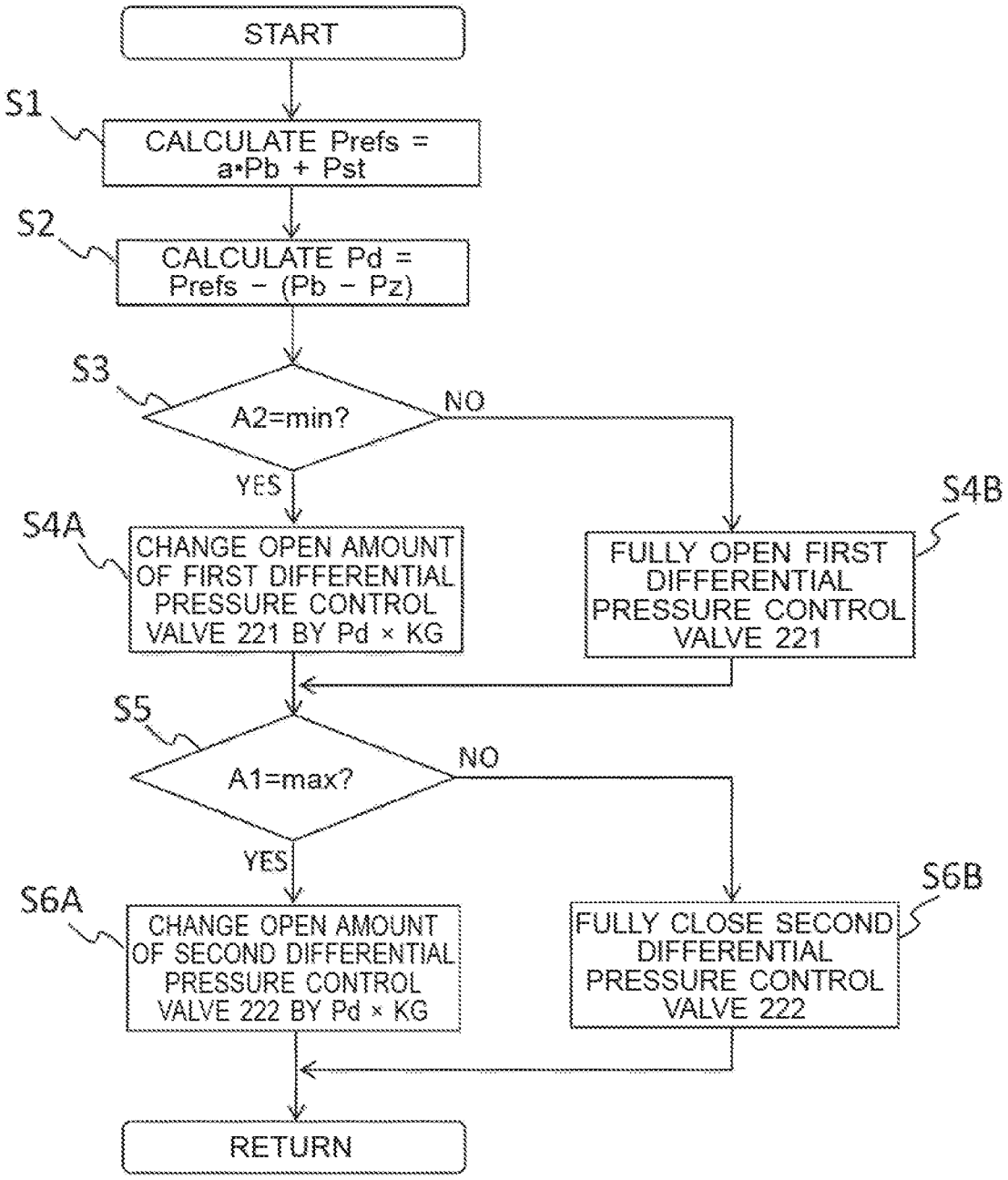
FIG. 11 is a flowchart describing contents of control processes of a first differential pressure control valve and a second differential pressure control valve according to the third embodiment.

First, the following describes the configuration of the hydraulic driving device 5B with reference to FIG. 10 and FIG. 11.

FIG. 10 is a drawing illustrating the configuration of the hydraulic driving device 5B according to the third embodiment. FIG. 11 is a flowchart describing contents of control processes of a first differential pressure control valve 221 and a second differential pressure control valve 222.

The hydraulic driving device 5B according to the embodiment includes the first pressure sensor 51 that detects the upstream pressure Pb (bottom pressure Pb) of the flow rate control valve 6, a second pressure sensor 52 that detects the downstream pressure Pz of the flow rate control valve 6, the first differential pressure control valve 221 located between the flow rate control valve 6 and the accumulator 300, the second differential pressure control valve 222 located between the flow rate control valve 6 and the tank 20, and the controller 50 that controls respective opening areas of the first differential pressure control valve 221 and the second differential pressure control valve 222.

The respective first differential pressure control valve 221 and second differential pressure control valve 222 are proportional solenoid valves that perform control such that the differential pressure (Pb−Pz) between the upstream pressure Pb detected by the first pressure sensor 51 and the downstream pressure Pz detected by the second pressure sensor 52, namely, the differential pressure between before and after the meter-out throttle 6*do* becomes the target differential pressure Prefs. This control is performed based on a signal output from the controller 50.

As illustrated in FIG. 11, the controller 50 calculates the target differential pressure Prefs determined by the upstream pressure Pb based on a signal (information on the upstream pressure Pb) from the first pressure sensor 51 and a signal (information on the downstream pressure Pz) from the second pressure sensor 52 (Step S1). This target differential pressure Prefs has a property similar to that of Formula (5) described in the first embodiment and the target differential pressure Prefs is obtained by the following Formula (6).

[Math. 6]

$$\text{Prefs}=a\cdot Pb+Pst \tag{6}$$

Here, the coefficient a is equivalent to a coefficient 1−Aa/Ab determined by a difference between the first pressure receiving area Aa and the second pressure receiving area Ab in the respective first differential pressure control valve 201 and second differential pressure control valve 202 according to the first embodiment and the coefficient a is a positive constant (a>0). Additionally, the constant Pst is a constant equivalent to Fsp/Ab in the above-described Formula (5), namely, the set pressure Psp.

Next, Pd=Prefs−(Pb−Pz), the differential pressure between the target differential pressure Prefs calculated at Step S1 and the differential pressure Pb−Pz is calculated (Step S2) and then it is determined whether an opening area A2 of the second differential pressure control valve 222 has a minimum value (Step S3).

In the case of YES at Step S3, an open amount of the first differential pressure control valve 221 is increased by a value found by multiplying the differential pressure Pd by a predetermined gain KG (Step S4A). In the case of NO at Step S3, the first differential pressure control valve 221 is fully opened (Step S4B).

Then, whether an opening area A1 of the first differential pressure control valve 221 has the maximum value is determined (Step S5). In the case of YES at Step S5, the open amount of the second differential pressure control valve 222 is increased by a value found by multiplying the differential pressure Pd by the predetermined gain KG (Step S6A). In the case of NO at Step S5, the second differential pressure control valve 222 is fully closed (Step S6B). Thus, the differential pressure (Pb−Pz) between before and after the meter-out throttle 6*do* of the flow rate control valve 6 on the position d side is controlled to be the target differential pressure Prefs.

In the case where the accumulator 300 is accumulable, the differential pressure (Pb−Pz) between before and after the meter-out throttle 6*do* is controlled to be the target differential pressure Prefs while the bottom chamber 3*a* of the boom cylinder 3 is coupled to the accumulator 300 with the first differential pressure control valve 221.

In the case where the accumulator 300 is sufficiently accumulated, the first differential pressure control valve 221 is fully opened and control is performed such that the differential pressure (Pb−Pz) between before and after the meter-out throttle 6*do* becomes the target differential pressure Prefs while the bottom chamber 3*a* of the boom cylinder 3 is coupled to the tank 20 with the second differential pressure control valve 222.

(Operation of Hydraulic Driving Device 5B)

Figure 12:
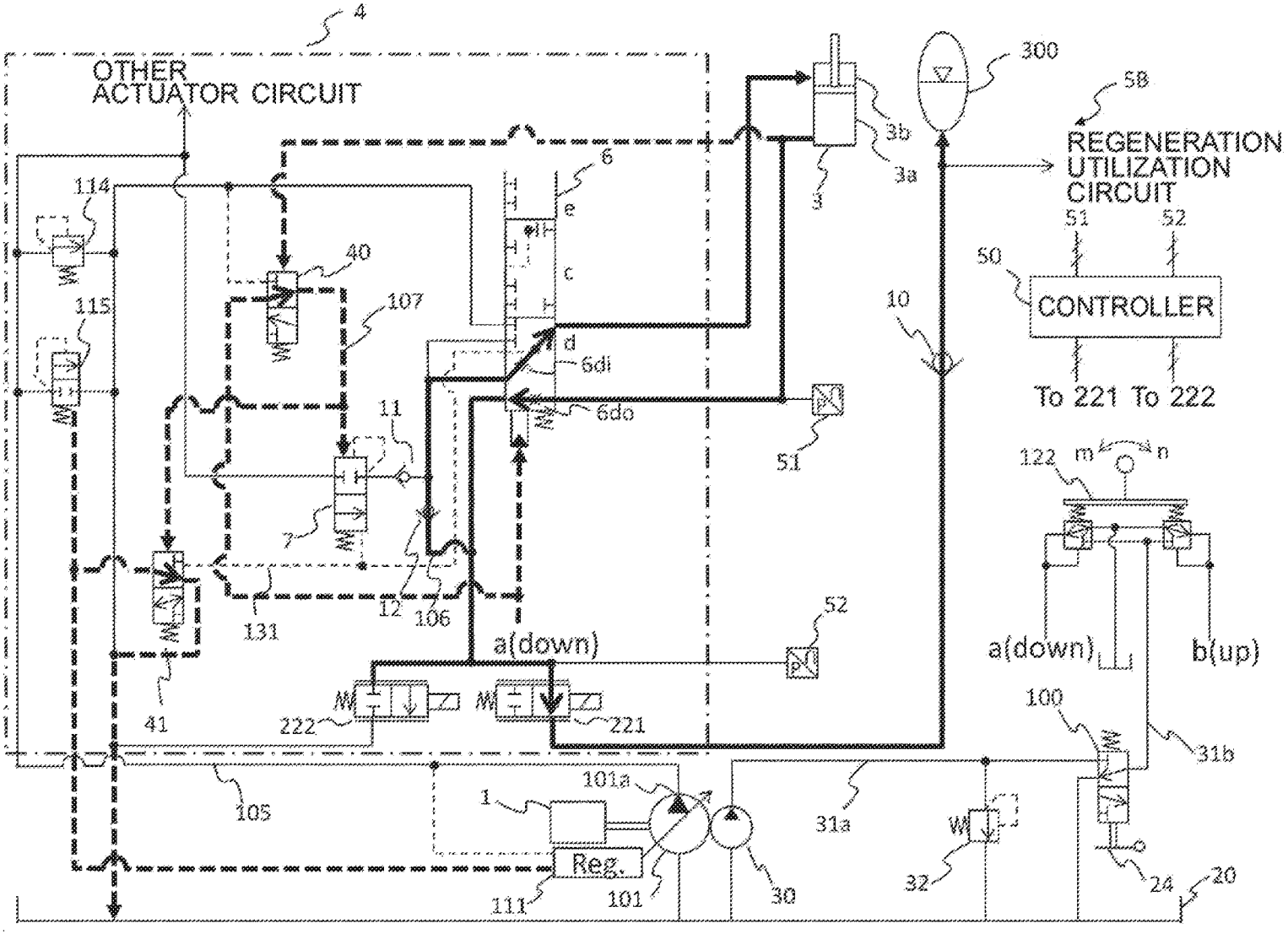
FIG. 12 is a drawing describing an operation of the hydraulic driving device according to the third embodiment when the boom lowering operation is performed in the air in a state where the accumulator is in the accumulable state.
Figure 13:
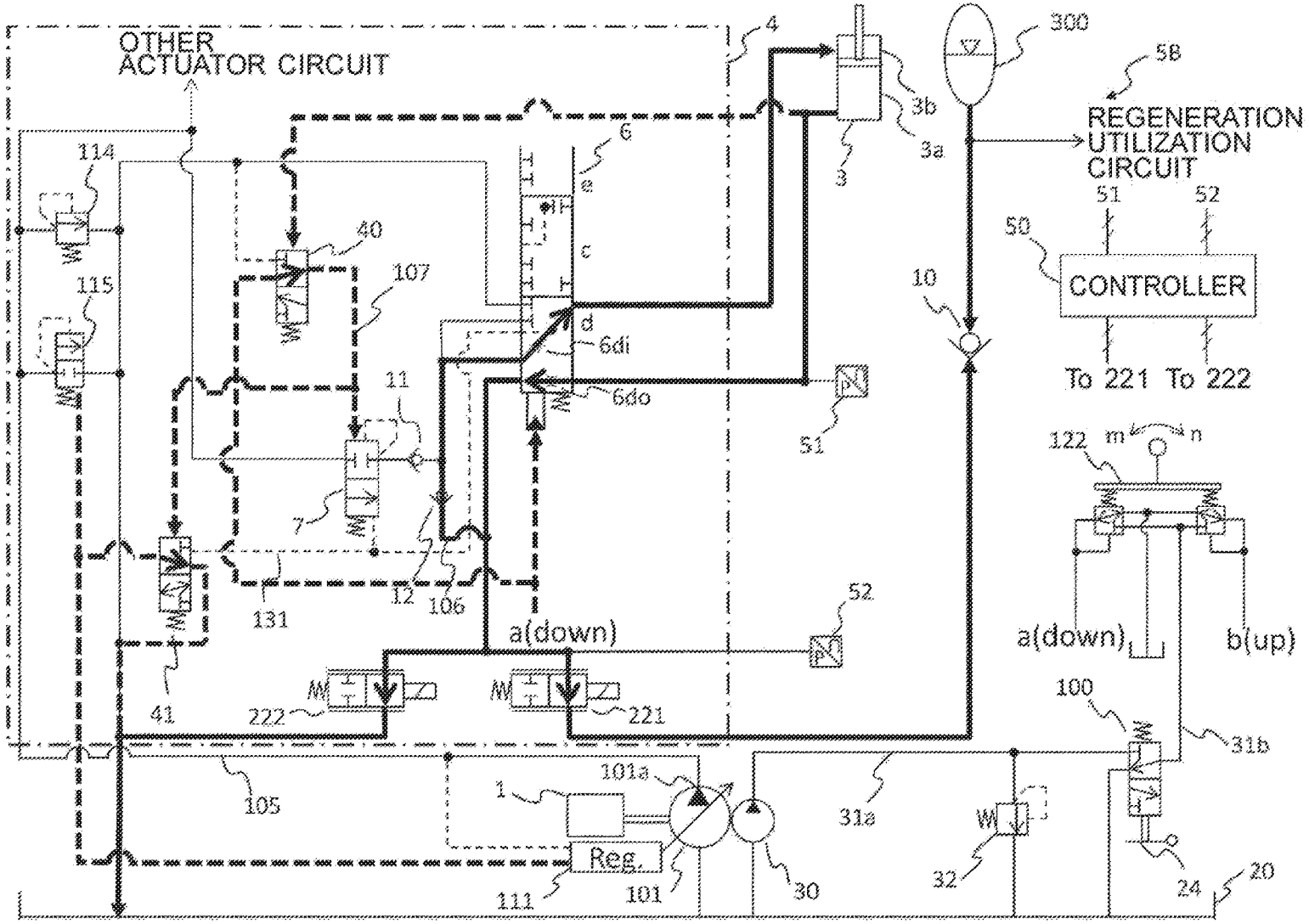
FIG. 13 is a drawing describing an operation of the hydraulic driving device according to the third embodiment when the boom lowering operation is performed in the air in a state where the accumulator is sufficiently accumulated.
Figure 14:
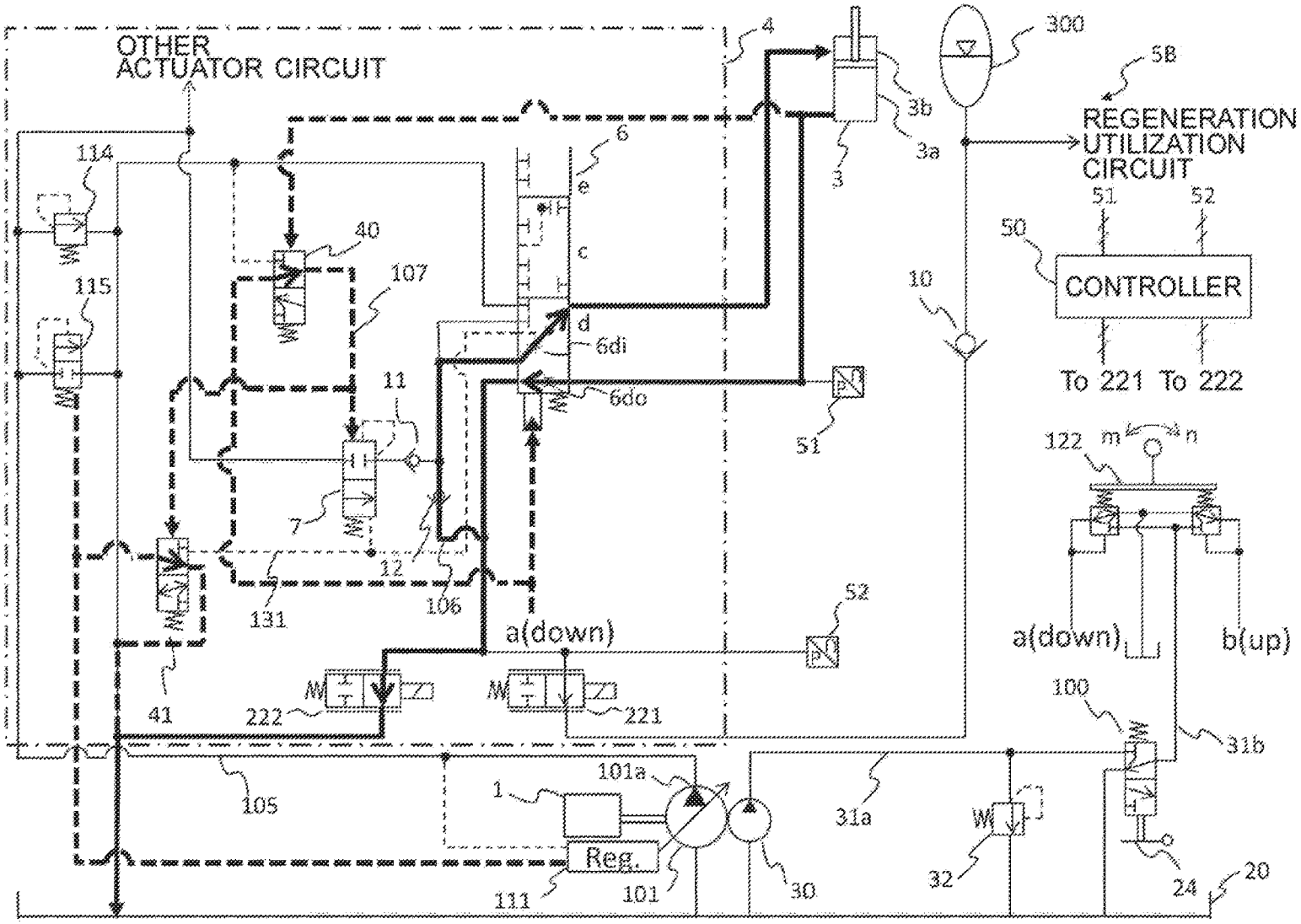
FIG. 14 is a drawing describing an operation of the hydraulic driving device according to the third embodiment when the body lift operation is performed.

Next, the following describes the operation of the hydraulic driving device 5B with reference to FIG. 12 and FIG. 13.

FIG. 12 is a drawing describing the operation of the hydraulic driving device 5B when the boom lowering operation is performed in the air in the state where the accumulator 300 is in the accumulable state. FIG. 13 is a drawing describing the operation of the hydraulic driving device 5B when the boom lowering operation is performed in the air in the state where the accumulator 300 is sufficiently accumulated.

First, (a) when the boom lowering operation is performed in the air in the state where the bucket 407 is unladen and the accumulator 300 is in the accumulable state, first, the controller 50 calculates the target differential pressure Prefs1 according to the magnitude of the bottom pressure Pb detected by the first pressure sensor 51. Since the accumulator 300 is in the accumulable state, the first differential pressure control valve 221 performs control such that the differential pressure (Pb−Pz) between before and after the meter-out throttle 6*do* of the flow rate control valve 6 on the position d side becomes the target differential pressure Prefs1.

At this time, the opening area A1 of the first differential pressure control valve 221 is less than the maximum value; therefore, the second differential pressure control valve 222 is not open (Step S6B in FIG. 11). In view of this, as illustrated in FIG. 12, the discharge oil is accumulated in the accumulator 300. Accordingly, when the boom lowering operation is performed in the air in the state where the bucket 407 is unladen and the accumulator 300 is in the accumulable state, the boom cylinder 3 can be operated at the cylinder speed determined by the target differential pressure Prefs1 while the energy is accumulated in the accumulator 300 by the boom lowering operation.

Next, (b) when the boom lowering operation is performed in the air in the state where the bucket 407 is unladen and the accumulator 300 is sufficiently accumulated, similarly to the case (a) in this embodiment, first, the controller 50 calculates the target differential pressure Prefs1 according to the magnitude of the bottom pressure Pb detected by the first pressure sensor 51 (Step S1 in FIG. 11).

Since the accumulator 300 is in the sufficiently accumulated state, as illustrated in FIG. 13, the action of the check valve 10 avoids the discharge oil to flow in the accumulator 300. In view of this, the differential pressure (Pb−Pz) between before and after the meter-out throttle 6*do* of the flow rate control valve 6 on the position d side becomes smaller than the target differential pressure Prefs1 (Pb−Pz<Prefs1).

At this time, since the opening area A1 of the first differential pressure control valve 221 becomes the maximum value, the second differential pressure control valve 222 performs control (Step S6A in FIG. 11). The second differential pressure control valve 222 is actuated such that the differential pressure (Pb−Pz) between before and after the meter-out throttle 6*do* becomes the target differential pressure Prefs1. The actuation of the second differential pressure control valve 222 allows the discharge oil to flow out to the tank 20 and the cylinder speed of the boom cylinder 3 can be reliably controlled. Accordingly, even when the boom lowering operation is performed in the air in the state where the bucket 407 is unladen and the accumulator 300 is sufficiently accumulated, the boom cylinder 3 can be operated at the cylinder speed determined by the target differential pressure Prefs1.

Next, (c) when the boom lowering operation is performed in the air in the state where the burden lifted by the bucket 407 applies the load weight to the front working device 404 and the accumulator 300 is in the accumulable state, the value of the bottom pressure Pb becomes larger than that in the case where the bucket 407 is unladen. Therefore, the controller 50 calculates the target differential pressure Prefs2 larger than the target differential pressure Prefs1 (Prefs2>Prefs1) according to the bottom pressure Pb detected by the first pressure sensor 51 (Step S1 in FIG. 11).

Accordingly, even when the boom lowering operation is performed in the air in the state where the burden lifted by the bucket 407 applies the load weight to the front working device 404 and the accumulator 300 is in the accumulable state, the boom cylinder 3 operates at the cylinder speed determined by the target differential pressure Prefs2.

At this time, as described above, the target differential pressure Prefs2 is larger than the target differential pressure Prefs1 in unladen (Prefs2>Prefs1); therefore, the flow rate through the meter-out throttle 6*do* of the flow rate control valve 6 on the position d side increases and the cylinder speed of the boom cylinder 3 becomes fast.

Thus, since the cylinder speed of the boom cylinder 3 becomes fast according to the increase in the load weight applied to the boom cylinder 3, similarly to the first embodiment and the second embodiment, the hydraulic driving device 5B including the accumulator 300 can also have the operability meeting the general recognition of the operator that the front working device 404 having a heavy burden falls down faster than the case where the front working device 404 is unladen.

Next, (d) when the boom lowering operation is performed in the air in the state where the burden lifted by the bucket 407 applies the load weight to the front working device 404 and the accumulator 300 is sufficiently accumulated, similarly to the case (c) of this embodiment, the value of the bottom pressure Pb becomes larger than that in the case where the bucket 407 in unladen. Therefore, the controller 50 calculates the target differential pressure Prefs2 larger than the target differential pressure Prefs1 (Prefs2>Prefs1) according to the bottom pressure Pb detected by the first pressure sensor 51 (Step S1 in FIG. 11).

Accordingly, even when the boom lowering operation is performed in the air in the state where the burden lifted by the bucket 407 applies the load weight to the front working device 404 and the accumulator 300 is sufficiently accumulated, the boom cylinder 3 operates at the cylinder speed determined by the target differential pressure Prefs2.

At this time, similarly to the case (c) of this embodiment, the target differential pressure Prefs2 is larger than the target differential pressure Prefs1 in unladen (Prefs2>Prefs1); therefore, the flow rate through the meter-out throttle 6*do* of the flow rate control valve 6 on the position d side increases and the cylinder speed of the boom cylinder 3 becomes fast.

Thus, since the cylinder speed of the boom cylinder 3 becomes fast according to the increase in the load weight applied to the boom cylinder 3, in the case (d) of this embodiment, the hydraulic driving device 5B including the accumulator 300 can also have the operability meeting the general recognition of the operator that the front working device 404 having the heavy burden falls down faster than the case where the front working device 404 is unladen similarly to the case (c).

Next, (e) when the heavy load occurs in the rod chamber 3*b* of the boom cylinder 3 (when the body lift operation is performed) at the boom lowering operation, the value of the bottom pressure Pb becomes smaller than that in the case where the bucket 407 is unladen. Therefore, the controller 50 calculates the target differential pressure Prefs3 smaller than the target differential pressure Prefs1 (Prefs3<Prefs1) according to the bottom pressure Pb detected by the first pressure sensor 51 (Step S1 in FIG. 11).

Thus, when the heavy burden occurs in the rod chamber 3*b* of the boom cylinder 3 at the boom lowering operation, the bottom pressure Pb decreases and therefore the downstream pressure Pz of the meter-out throttle 6*do* also decreases, always meeting Pd=Pref3−(Pb−Pz) (>0).

As illustrated in FIG. 11, the first differential pressure control valve 221 strokes in the full open direction at Step S4B, and the second differential pressure control valve 222 strokes in the open direction at Step S6A. This discharges the discharge oil to the tank 20.

Thus, the first differential pressure control valve 221 and the second differential pressure control valve 222 are actuated so as to discharge the discharge oil to tank 20 even when the load occurs in the boom lowering operation; therefore, the body lift operation can be performed.

The embodiments of the present invention have been described above. The present invention is not limited to the above-described embodiments but includes various modifications. For example, the above-described embodiments have been described in detail for easy understanding of the present invention, and therefore, it is not necessarily limited to include all described configurations. It is possible to replace a part of the configuration of this embodiment with a configuration of another embodiment, and it is possible to add a configuration of another embodiment to a configuration of this embodiment. Additionally, addition, removal, or replacement of another configuration is possible to a part of the configuration of this embodiment.

For example, while the above-described embodiments have described the hydraulic driving devices 5, 5A, and 5B of the boom cylinder 3, this should not be constructed in a limiting sense, and it may be applied to any hydraulic actuator including, for example, the arm cylinder 408 and the bucket cylinder 409.

While in the above-described embodiments, the differential pressure control is performed on the pressure oil discharged from the bottom chamber 3*a* of the boom cylinder 3, this should not be constructed in a limiting sense. For example, when the present invention is applied to the arm cylinder 408, the differential pressure control can be performed on pressure oil discharged from a rod chamber to adjust a load caused by gravity received by the rod chamber.

In the above-described embodiments, while the hydraulic driving devices 5, 5A, and 5B are applied to the hydraulic excavator 400, this should not be constructed in a limiting sense. It may be applied to, for example, a working machine such as a wheel loader.

LIST OF REFERENCE SIGNS

3: boom cylinder (hydraulic actuator)
3*a*: bottom chamber
5, 5*a*, 5*b*: hydraulic driving device
6: flow rate control valve
20: tank
30: pilot pump
51: first pressure sensor
52: second pressure sensor
60: mode adjuster (adjuster)
70: solenoid proportional pressure reducing valve (pressure reducing valve)
101: main pump (hydraulic pump)
201, 211, 221: first differential pressure control valve
201*a*: first pressure receiving chamber
201*b*: second pressure receiving chamber
202, 212, 222: second differential pressure control valve
211*c*, 212*c*: third pressure receiving chamber
300: accumulator
400: hydraulic excavator (working machine)
Aa: first pressure receiving area
Ab: second pressure receiving area

The invention claimed is:

1. A hydraulic driving device for a working machine comprising:

a hydraulic pump;

a hydraulic actuator driven by pressure oil supplied from the hydraulic pump;

a tank that accumulates return oil from the hydraulic actuator;

a flow rate control valve that controls a flow of the pressure oil discharged from the hydraulic actuator;

an accumulator that accumulates the pressure oil discharged from a bottom chamber of the hydraulic actuator and flowing to the tank via the flow rate control valve;

a first differential pressure control valve located between the hydraulic actuator and the accumulator, the first differential pressure control valve performing control on the pressure oil discharged from the hydraulic actuator such that a differential pressure between an upstream pressure and a downstream pressure of the flow rate control valve becomes a predetermined target differential pressure; and a second differential pressure control valve located between the accumulator and the tank, the second differential pressure control valve performing control on the pressure oil discharged from the hydraulic actuator such that a differential pressure between an upstream pressure and a downstream pressure of the flow rate control valve and the first differential pressure control valve becomes the predetermined target differential pressure, wherein the respective first differential pressure control valve and second differential pressure control valve are configured such that the predetermined target differential pressure increases according to an increase in pressure of the pressure oil discharged from the hydraulic actuator.

2. The hydraulic driving device for a working machine according to claim 1, wherein the first differential pressure control valve is a pressure compensation valve including a first pressure receiving chamber on which the upstream pressure of the flow rate control valve acts and a second pressure receiving chamber on which the downstream pressure of the flow rate control valve acts, the second differential pressure control valve is a pressure compensation valve including a first pressure receiving chamber on which the upstream pressure of the flow rate control valve and the first differential pressure control valve acts and a second pressure receiving chamber on which the downstream pressure of the flow rate control valve and the first differential pressure control valve acts, the first pressure receiving chamber of the first differential pressure control valve has a first pressure receiving area smaller than a second pressure receiving area of the second pressure receiving chamber of the first differential pressure control valve, and the first pressure receiving chamber of the second differential pressure control valve has a first pressure receiving area smaller than a second pressure receiving area of the second pressure receiving chamber of the second differential pressure control valve.

3. The hydraulic driving device for a working machine according to claim 1, wherein the first differential pressure control valve is a pressure compensation valve including a first pressure receiving chamber on which the upstream pressure of the flow rate control valve acts and a second pressure receiving chamber on which the downstream pressure of the flow rate control valve acts, and the second differential pressure control valve is a pressure compensation valve including a first pressure receiving chamber on which the upstream pressure of the flow rate control valve and the first differential pressure control valve acts and a second pressure receiving chamber on which the downstream pressure of the flow rate control valve and the first differential pressure control valve acts, the hydraulic driving device further comprises a pressure reducing valve having a primary side coupled to a pilot pump and a secondary side coupled to respective third pressure receiving chamber of the first differential pressure control valve and third pressure receiving chamber of the second differential pressure control valve, the third pressure receiving chamber of the first differential pressure control valve being configured to cause the pressure to act in a direction identical to a direction of the second pressure receiving chamber of the first differential pressure control valve, the third pressure receiving chamber of the second differential pressure control valve being configured to cause the pressure to act in a direction identical to a direction of the second pressure receiving chamber of the second differential pressure control valve, and the pressure reducing valve increases an output pressure to the secondary side according to the increase in the pressure of the pressure oil discharged from the hydraulic actuator.

4. The hydraulic driving device for a working machine according to claim 3, further comprising an adjuster that changes an increased amount of the output pressure to the secondary side of the pressure reducing valve according to the increase in the pressure of the pressure oil discharged from the hydraulic actuator.

5. A hydraulic driving device for a working machine comprising:

a hydraulic pump;

a hydraulic actuator driven by pressure oil supplied from the hydraulic pump;

a tank that accumulates return oil from the hydraulic actuator;

a flow rate control valve that controls a flow of the pressure oil discharged from the hydraulic actuator;

an accumulator that accumulates the pressure oil discharged from a bottom chamber of the hydraulic actuator and flowing to the tank via the flow rate control valve;

a first pressure sensor that detects an upstream pressure of the flow rate control valve;

a second pressure sensor that detects a downstream pressure of the flow rate control valve;

a first differential pressure control valve located between the flow rate control valve and the accumulator; and a second differential pressure control valve located between the flow rate control valve and the tank, wherein the respective first differential pressure control valve and second differential pressure control valve are proportional solenoid valves that perform control on the pressure oil discharged from the hydraulic actuator such that a differential pressure between the upstream pressure detected by the first pressure sensor and the downstream pressure detected by the second pressure sensor becomes a predetermined target differential pressure, and the predetermined target differential pressure is configured to increase according to an increase in pressure of the pressure oil discharged from the hydraulic actuator.

* * * * *